US007699030B2

(12) United States Patent
Nomura

(10) Patent No.: US 7,699,030 B2
(45) Date of Patent: Apr. 20, 2010

(54) VARIABLE VALVE SYSTEM OF INTERNAL COMBUSTION ENGINE

(75) Inventor: Akifumi Nomura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 135 days.

(21) Appl. No.: 11/878,240

(22) Filed: Jul. 23, 2007

(65) Prior Publication Data

US 2008/0022951 A1 Jan. 31, 2008

(30) Foreign Application Priority Data

Jul. 25, 2006 (JP) ..... 2006-201590
May 23, 2007 (JP) ..... 2007-136404

(51) Int. Cl.
*F01L 1/34* (2006.01)

(52) U.S. Cl. ..... 123/90.16; 123/90.15; 123/90.39

(58) Field of Classification Search ..... 123/90.15, 123/90.16, 90.39
See application file for complete search history.

(56) References Cited

U.S. PATENT DOCUMENTS 4,498,432 A * 2/1985 Hara et al. ..... 123/90.16

FOREIGN PATENT DOCUMENTS

DE 41 12 204 A1 10/1991
DE 195 81 378 T1 12/1996
DE 195 36 090 A1 4/1997
DE 602 00 033 T2 4/2004
FR 2 567 569 A1 1/1986
JP 55-91714 A 7/1980
JP 60-81412 A 5/1985
JP 2000-227033 A 8/2000
JP 2002-276315 A 9/2002

* cited by examiner

*Primary Examiner*—Zelalem Eshete
(74) *Attorney, Agent, or Firm*—Birch, Stewart, Kolasch and Birch, LLP

(57) ABSTRACT

An internal combustion engine includes a variable valve system wherein each cam opens and closes an intake valve and an exhaust valve via each rocker arm. A variable valve system of an internal combustion engine E includes rocker arms rocked by the action of valve driving force of cams with each lift quantity variable mechanism varying a maximum lift quantity of an intake valve and an exhaust valve. The lift quantity variable mechanism includes a lifter that is driven by the cam, and makes the valve driving force act on the rocker arm and a lifter holder that supports the lifter, and is driven by an electric motor and is rocked. The lifter is movably supported by the lifter holder. Maximum lift quantity is varied by varying a position in which the lifter abuts on the rocker arm according to a position in which the lifter holder is turned.

19 Claims, 14 Drawing Sheets

VARIABLE VALVE SYSTEM OF INTERNAL COMBUSTION ENGINE

CROSS-REFERENCE TO RELATED APPLICATIONS

The present application claims priority under 35 USC 119 to Japanese Patent Application Nos. 2006-201590 and 2007-136404 filed on Jul. 25, 2006 and May 23, 2007, respectively, the entire contents of which are hereby incorporated by reference.

BACKGROUND OF THE INVENTION

1. Field of the Invention

The present invention relates to variable valve systems that can vary a valve operational characteristic such as maximum lift quantity and opening/closing timing of an engine valve which is an intake valve or an exhaust valve in an internal combustion engine. More specifically, the invention relates to the variable valve system provided with a lift quantity variable mechanism that can vary the maximum lift quantity of the engine valve.

2. Description of Background Art

A variable valve system of an internal combustion engine provided with a cam provided to a cam shaft is known wherein a rocker arm is rocked by the action of a valve driving force of the cam and a lift quantity variable mechanism varies maximum lift quantity of an engine valve. See, for example, JP-A No. 2002-276315.

In addition, a variable valve system is known wherein a timing variable mechanism is provided with a hydraulic actuator. When the actuator operated according to the supply and the exhaust of hydraulic fluid rotates a camshaft, a phase of the camshaft with a crankshaft of an internal combustion engine is varied and the opening and closing timing of an engine valve is varied. See, for example, JP-A No. 2000-227033.

As the whole rocker arm is moved together with a rocker shaft with the cam shaft provided to a cylinder head of the internal combustion engine in the center by the lift quantity variable mechanism of the variable valve system and a space for moving the whole rocker arm and the rocker shaft is required to be secured around the cam shaft when the maximum lift quantity of the engine valve is varied, the cylinder head is large-sized. As a result, the internal combustion engine is large-sized.

In addition, in the valve system in which the cam opens and closes the engine valve via the rocker arm, it is desirable that the inertia mass of members including the rocker arm between the cam and the engine valve is reduced so as to enhance the responsiveness of opening and closing the engine valve during a high-speed operation of the internal combustion engine.

Further, in the variable valve system in which the maximum lift quantity of the engine valve is continuously varied, as the maximum lift quantity is continuously reduced to approximately zero by the lift quantity variable mechanism when the engine valve is halted, it takes much time since an operated condition in which the engine valve is operated at the large maximum lift quantity till a halted condition or since the halted condition till the operated condition at the large maximum lift quantity and the time lag of switching between the operated condition and the halted condition may increase.

In addition, when the lift quantity variable mechanism is provided with a rocking member that can rock the camshaft to vary the maximum lift quantity, a part for supporting the rocking member is provided to the camshaft or is provided alongside in an axial direction of the camshaft together with a bearing of the camshaft in a cam holder that rotatably supports the camshaft, thereby, the length of the camshaft is extended, and the internal combustion engine may be large-sized in the axial direction of the camshaft in the body (for example, a cylinder head) provided with the camshaft of the engine.

Further, when the variable valve system is provided with a hydraulic actuator that drives the lift quantity variable mechanism, the compact arrangement and the miniaturization of the hydraulic actuator are required in view of the miniaturization of the internal combustion engine.

SUMMARY AND OBJECTS OF THE INVENTION

According to an embodiment of the present invention, an internal combustion engine provided with a variable valve system in which a cam opens and closes an engine valve via a rocker arm is miniaturized.

According to an embodiment of the present invention, a lifter that transmits valve driving force of the cam to the rocker arm and the cam or the rocker arm is prevented from colliding.

According to an embodiment of the present invention, an operated condition and a halted condition in the variable valve system that continuously varies maximum lift quantity of the engine valve are properly switched.

According to an embodiment of the present invention, the length of a camshaft by devising structure for supporting a lifter holder in the variable valve system where the lifter holder of a lift quantity variable mechanism is further reduced and is rockably supported by the camshaft rotatably supported by a cam holder.

According to an embodiment of the present invention, the hydraulic actuator is arranged compactly in an axial direction of the camshaft by devising the oil passage structure of hydraulic fluid supplied and exhausted to/from the hydraulic actuator that drives the lift quantity variable mechanism.

According to an embodiment of the present invention, the hydraulic actuator that drives the lift quantity variable mechanism in a radial direction of the camshaft is further miniaturized.

According to an embodiment of the present invention, a variable valve system of an internal combustion engine is provided with a cam provided to a cam shaft, a rocker arm rocked by the action of valve driving force of the cam, a lift quantity variable mechanism that varies maximum lift quantity of an engine valve and an actuator that drives the lift quantity variable mechanism. In addition, the cam opens and closes the engine valve via the rocker arm. Further, the variable valve system of the internal combustion engine where the lift quantity variable mechanism is provided with a lifter driven by the cam for applying the valve driving force to the rocker arm and a lifter holder that supports the lifter, is driven by the actuator and is rocked. When a position in which the lifter abuts on the rocker arm is varied according to a position of the lifter holder, the maximum lift quantity is varied.

According to an embodiment of the present invention, the lifter is provided with an input lifter which abuts on the cam, an output lifter which abuts on the rocker arm and a pressing member which presses the input lifter and the output lifter on the cam and on the rocker arm. The input lifter and the output lifter can be relatively moved in a direction pressed by the pressing member.

According to an embodiment of the present invention, a valve halt mechanism which halts the engine valve without varying a position of the lifter holder is provided. In addition, the lift quantity variable mechanism can continuously vary the maximum lift quantity.

According to an embodiment of the present invention, the variable valve system of the internal combustion engine discloses that the lifter is provided with an input lifter which abuts on the cam and an output lifter which abuts on the rocker arm and that the valve halt mechanism transmits or disconnects the valve driving force between the input lifter and the output lifter.

According to an embodiment of the present invention, the variable valve system of the internal combustion engine is provided wherein the engine valve is provided to a cylinder head of the internal combustion engine, is at least one of a plurality of engine valves per one cylinder and the actuator is arranged between the plurality of engine valves when the actuator is viewed in an axial direction of the cylinder.

According to an embodiment of the present invention, the variable valve system of the internal combustion engine is provided with the camshaft that is rotatably supported by a cam holder via the lifter holder rockably supported by the camshaft.

According to an embodiment of the present invention, the variable valve system of the internal combustion engine includes the camshaft that is rotatably supported by a cam holder, one end and the other end of the camshaft are rotatably supported by a first bearing and a second bearing of the cam holder, the actuator is a hydraulic actuator attached to the first bearing, and an oil passage for hydraulic fluid for operating the actuator is provided to the first bearing.

According to an embodiment of the present invention, the variable valve system of the internal combustion engine is provided with the one end that is rotatably supported by the first bearing via the lifter holder rockably supported by the first bearing. An oil passage which makes the oil passage and the actuator communicate and in which the hydraulic fluid is led is provided to the lifter holder.

According to an embodiment of the present invention, to vary the maximum lift quantity of the engine valve, as the lifter has only to be moved on the rocker arm by rocking the lifter holder that movably supports the lifter which abuts on the rocker arm by the actuator, space around the cam shaft which is a space where the rocker arm is arranged can be reduced, as compared with a case wherein the whole rocker arm is moved and the internal combustion engine is miniaturized.

According to an embodiment of the present invention, as the input lifter and the output lifter are respectively relatively movable in the pressed direction are pressed on the cam and on the rocker arm by the pressing member and are touched to the cam and to the rocker arm, no clearance is made between the lifter and the cam or the rocker arm. Thus, the collision of the lifter and the cam or the rocker arm is prevented, and noise caused by the collision is prevented from being made.

According to an embodiment of the present invention, the valve halt mechanism halts the engine valve without moving the lifter holder, therefore, without varying maximum lift quantity continuously set according to a position of the lifter holder, the setting of the maximum lift quantity by the lift quantity variable mechanism and the switching of the operated condition and the halted condition of the engine valve by the valve halt mechanism can be independently executed, and the operated condition and the halted condition of the engine valve are always promptly switched independent of the maximum lift quantity of the engine valve.

According to an embodiment of the present invention, the valve halt mechanism can be provided to the lifter holder without making the structure of the rocker arm intricate.

According to an embodiment of the present invention, the electric motor is arranged between the plural engine valves provided to the cylinder head in one cylinder. Thus, the cylinder head is miniaturized and as a result, the internal combustion engine is miniaturized.

According to an embodiment of the present invention, the camshaft is supported by the cam holder via the lifter holder. A part for supporting the lifter holder is not required to be provided to the camshaft. In addition, parts for supporting both the camshaft and the lifter holder are not required to be provided to the cam holder alongside in the axial direction of the camshaft. Thus, the length of the camshaft can be reduced. As a result, the variable valve system provided with the lifter holder can be miniaturized in the axial direction of the camshaft and thereby, the internal combustion engine can be miniaturized in the axial direction in the body where the camshaft is provided in the engine.

According to an embodiment of the present invention, the oil passage for leading hydraulic fluid for operating the hydraulic actuator that drives the lift quantity variable mechanism is provided to the first bearing that supports one end of the camshaft to which the hydraulic actuator is attached. Thus, the intricacy of the oil passage structure for the hydraulic actuator is avoided. The hydraulic actuator can be arranged close to the first bearing in the axial direction of the camshaft, and the hydraulic actuator can be arranged compactly in the axial direction of the camshaft.

According to an embodiment of the present invention, one end of the camshaft is supported by the cam holder via the lifter holder. A part for supporting the lifter holder is not required to be provided to the camshaft. In addition, parts supporting both the camshaft and the lifter holder are not required to be provided to the cam holder alongside in the axial direction of the camshaft. Thus, the length of the camshaft can be reduced. The variable valve system provided with the lifter holder can be miniaturized in the axial direction of the camshaft, and as a result, the body of the engine is miniaturized in the axial direction of the camshaft. In addition, as the oil passage for hydraulic fluid for operating the hydraulic actuator is provided to the lifter holder arranged between the camshaft and the bearing, the oil passage can be provided inside the first bearing in the radial direction of the camshaft. Thus, the hydraulic actuator can be miniaturized in the radial direction of the camshaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5(*b*) is a graph showing valve operational characteristics acquired by the variable valve system shown in FIG. 1, wherein FIG. 5(*b*) shows the valve operational characteristic when a timing variable mechanism is operated in a condition in which no maximum lift quantity is varied by the lift quantity variable mechanism;

DETAILED DESCRIPTION OF THE PREFERRED EMBODIMENTS

Referring to FIGS. 1 to 15, embodiments of the invention will be described below.

FIGS. 1 to 5 are explanatory drawings for explaining a first embodiment.

Figure 1:
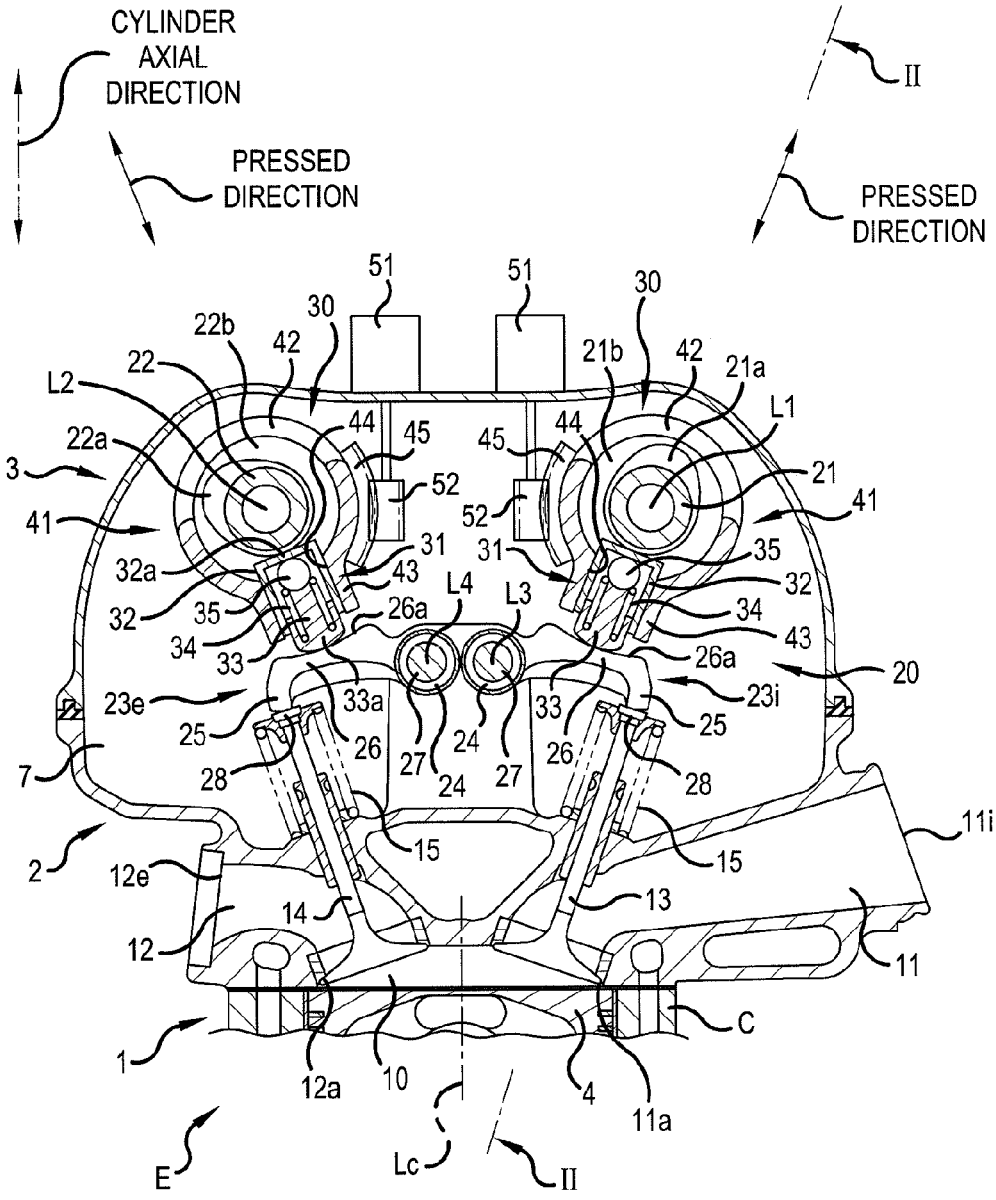
FIG. 1 is a sectional view illustrating a first embodiment of the invention wherein a main part of an internal combustion engine is provided with a variable valve system to which the invention is applied on a plane perpendicular to a rotational center line of a cam shaft.
Figure 2:
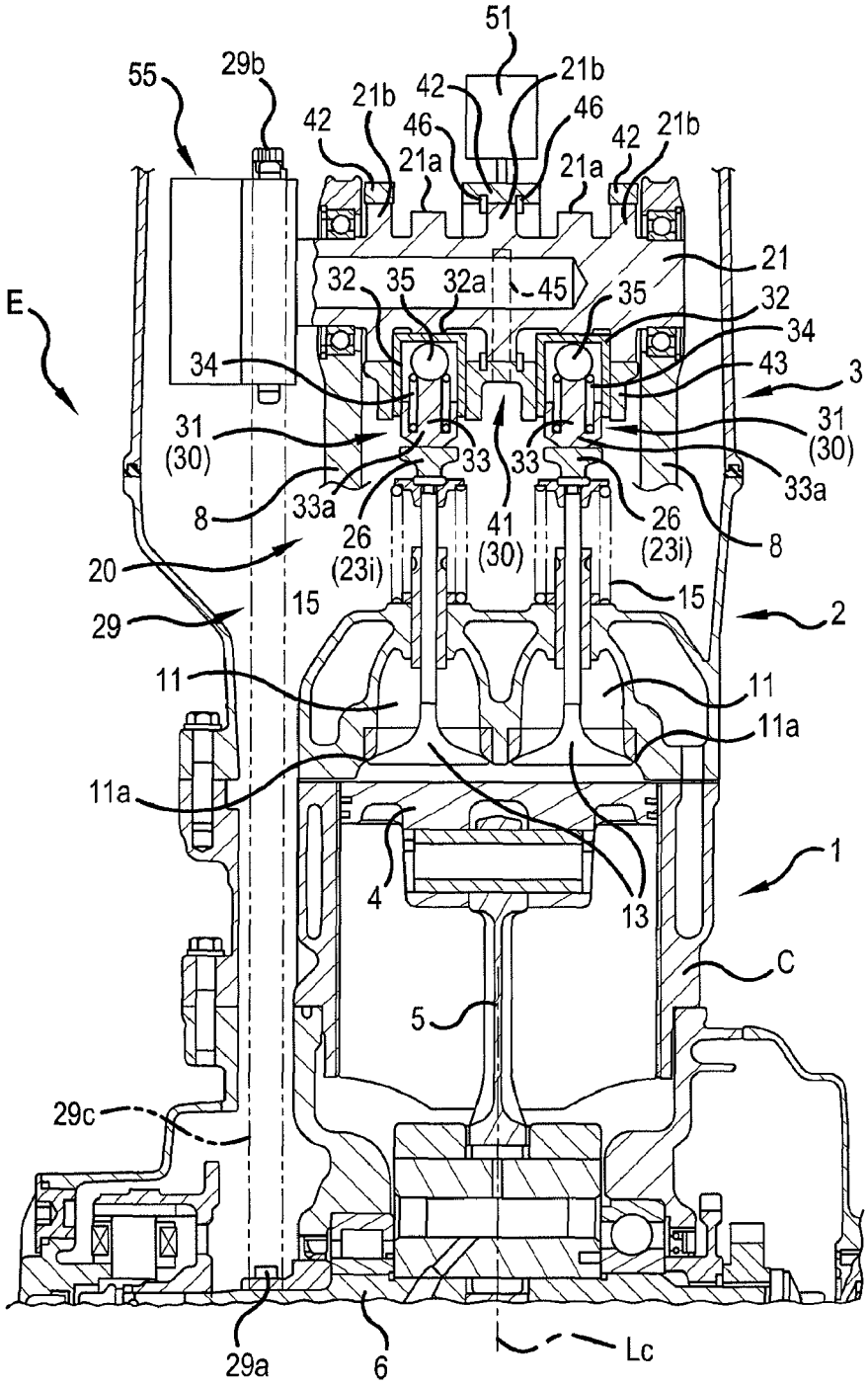
FIG. 2 is a schematic sectional view viewed along a line II-II in FIG. 1.

As shown in FIGS. 1 and 2, an internal combustion engine E to which the invention is applied is a water-cooled single-cylinder 4-stroke internal combustion engine with a crankshaft 6 mounted with the crankshaft arranged transversely in a direction of the width of the body in a motorcycle.

The internal combustion engine E is provided with a body of the engine including a cylinder block 1 having one cylinder C in which a piston 4 is reciprocatably fitted. A cylinder head 2 is connected to an upper end of the cylinder block 1 with a head cover 3 connected to an upper end of the cylinder head 2. Therefore, the cylinder block 1, the cylinder head 2 and the head cover 3 configure the body of the engine.

A vertical direction shall hereinafter be referred to in an axial direction of the cylinder (hereinafter called a cylinder axial direction), an axial direction shall be a direction of a rotational center line of a cam shaft of a variable valve system, and a radial direction and a circumferential direction shall be a radial direction and a circumferential direction with the rotational center line in the center.

The cylinder head 2 is provided with a combustion chamber 10 opposite to the piston 4 in the cylinder axial direction. An intake port 11 is open to the combustion chamber 10 at a pair of inlets 11*a* with an exhaust port 12 open to the combustion chamber 10 at a pair of outlets 12*a*. A spark plug (not shown) is opposite to the combustion chamber 10. A pair of intake valves 13 are provided which are engine valves for opening and closing a pair of inlets 11*a*. A pair of exhaust valves 14 are provided which are engine valves for opening and closing a pair of outlets 12*a*. The intake valve 13 and the exhaust valve 14 respectively are pressed in a direction in which they are closed by a resilient force of each valve spring 15 and are driven by a variable valve system 20 housed in a valve chamber 7 formed by the cylinder head 2 and the head cover 3 in cooperation and perform an opening/closing operation.

The internal combustion engine E is provided with an intake system (not shown) connected to a side wall to which an entrance 11*i* of each intake port 11 is open on the air intake side of the cylinder head 2 and an exhaust system (not shown) connected to a side wall to which an exist 12*e* of each exhaust port 12 is open on the exhaust side of the cylinder head 2. Intake air flowing in an intake air passage formed by the intake system is taken in the combustion chamber 10 via the intake port 11 when the intake valve 13 is opened after it is measured by a throttle valve. The intake air is mixed with fuel from a fuel injection valve as a fuel feeder in the intake air passage or in the combustion chamber 10. Thus, an air-fuel mixture is generated. The air-fuel mixture in the combustion chamber 10 is ignited by the spark plug, is combusted, and the piston 4 is driven by generated combustion gas for rotating the crankshaft 6 via a connecting rod 5. The combustion gas is exhausted into the exhaust port 12 when the exhaust valve 14 is opened as exhaust gas and further, is emitted outside the internal combustion engine E via an exhaust gas passage formed by the exhaust system.

The variable valve system 20 is provided with an inlet camshaft 21 and an exhaust camshaft 22 which are a pair of camshafts provided to the cylinder head 2 and mutually parallel. Inlet cams 21*a* are integrated with the inlet camshaft 21 and are a pair of valve cams that open and close a pair of intake valves 13. Exhaust cams 22*a* are integrated with the exhaust camshaft 22 and are a pair of valve cams that open and close a pair of exhaust valves 14. A pair of intake rocker arms 23*i* and a pair of exhaust rocker arms 23*e* are respectively rocker arms rocked by the action of the valve driving force of the inlet cams 21*a* and the exhaust cams 22*a*. A pair of lift quantity variable mechanisms 30 vary maximum lift quantity of the intake valve 13 and the exhaust valve 14 according to an operational condition of the internal combustion engine E. A pair of electric motors 51 drive the lift quantity variable mechanism 30 as an actuator. A pair of timing variable mechanisms 55 are provided to each camshaft 21, 22 to vary a phase of each camshaft 21, 22 with the crankshaft 6 as a rotating shaft rotated in synchronization with engine speed.

Each cam shaft 21, 22, rotatably supported by a cam holder 8 provided to the cylinder head 2, is rotated at ½ of its revolution speed in synchronization with the crankshaft 6 via a valve driving transmission mechanism 29 provided with a driving sprocket 29*a* provided to the crankshaft 6, a cam sprocket 29*b* coupled to each cam shaft 21, 22 via the timing variable mechanism 55 and a timing chain 29*c* laid between the sprockets 29*a*, 29*b*.

Each rocker arm 23*i*, 23*e* is rockably supported by a pair of rocker shafts 27 supported by the cylinder head 2 with rock center lines L3, L4 in the center. Each rocker shaft 27 is arranged between both cam shafts 21, 22 or between the intake valve 13 and the exhaust valve 14 in a direction perpendicular to a cylinder axis Lc (hereinafter called a perpendicular direction) when each rocker shaft is viewed in the axial direction.

The intake rocker arm 23*i* is provided with a fulcrum part 24 supported by the rocker shaft 27, a valve pressing part 25 that presses a valve stem of the intake valve 13 via a shim 28 and an abutting part 26 on which a lifter 31 described later of the lift quantity variable mechanism 30 abuts and on which the valve driving force of the inlet cam 21*a* acts. The exhaust rocker arm 23*e* is also provided with a fulcrum part 24 supported by the rocker shaft 27, a valve pressing part 25 that presses a valve stem of the exhaust valve 14 and an abutting part 26 on which a lifter 31 abuts and on which valve driving force of the exhaust cam 22*a* acts.

As the lift quantity variable mechanism 30 and the timing variable mechanism 55 for the intake valve have the same structure as those for the exhaust valve, the lift quantity variable mechanism 30 and the timing variable mechanism 55 for the intake valve will be mainly described in the following description of the embodiment. Without particular reference, members related to the operation of the intake valve 13 such as the intake valve 13, the inlet cam shaft 21, the inlet cam 21*a* and the intake rocker arm 23*i* correspond to members related to the operation of the exhaust valve 14 such as the exhaust valve 14, the exhaust cam shaft 22, the exhaust cam 22*a* and the exhaust rocker arm 23*e* in relation to the lift quantity variable mechanism 30 and the timing variable mechanism 55 respectively for the exhaust valve.

The lift quantity variable mechanism 30 is provided with the lifter 31 that is driven by the inlet cam 21*a* and applies the valve driving force of the inlet cam 21*a* to the intake rocker arm 23*i* and a lifter holder 41 rocked in this embodiment that movably supports the lifter 31 and is driven and moved by the electric motor 51.

A pair of lifters 31 that are driven by each inlet cam 21*a* and press the intake rocker arm 23*i* are supported by the lifter holder 41 so that the lifter can be reciprocated in a radial direction of the inlet cam shaft 21. The lifter 31 is provided with an input lifter 32 that abuts on the inlet cam 21*a*, an output lifter 33 that abuts on the abutting part 26 of the intake rocker arm 23*i*, a spring 34 which is a resilient means as a pressing means for pressing the input lifter 32 and the output lifter 33 on the inlet cam 21*a* and the intake rocker arm 23*i* and a ball 35 as a transmission element that is arranged between the input lifter 32 and the output lifter 33 in a direction pressed by the spring 34 for transmitting the force between both lifters 32, 33. The spring 34 and the ball 35 are arranged inside the input lifter 32.

The input lifter 32 is made of a cylindrical member and is provided with a top wall 32*a* as the abutting part that abuts on the inlet cam 21*a*. The input lifter 32 is fitted into a through hole 44 provided to a holding part 43 of the lifter holder 41 in a radial direction and is slidably supported by the lifter holder 41. The output lifter 33 is provided with an end 33*a* as an abutting part that abuts on an abutting surface 26*a* of the abutting part 26. The output lifter 33 is fitted inside the input lifter 32 and is slidably supported by the input lifter 32. Therefore, the input lifter 32 and the output lifter 33 can be relatively moved in a pressing direction, the input lifter 32 constantly abuts on the inlet cam 21*a* by resilient force of the spring 34. In addition, the output lifter 33 constantly abuts on the abutting surface 26*a* of the intake rocker arm 23*i*.

The spring 34 is arranged between the ball 35 and the output lifter 33 and presses the ball 35 and the input lifter 32 on the top wall 32*a* of which the ball 35 is pressed by the spring 34 and abuts the output lifter 33 in a direction parallel to the pressing direction in which they are separated. A minute clearance, a valve clearance, is formed between the ball 35 and the output lifter 33 in the pressing direction.

When the lifter 31 is moved by the valve driving force of the inlet cam 21*a*, the input lifter 32 and the output lifter 33 are slid without rocking the lifter holder 41 and the intake rocker arm 23*i* is rocked according to the movement of the lifter 31. Therefore, the inlet cam 21*a* opens and closes the intake vale 13 via the lifter 31 and the rocker arm 23*i*.

The lifter holder 41, made of a cylinder member and arranged around the inlet cam shaft 21, is provided with a supported part 42 rockably supported by a supporting part 21*b* provided to the inlet cam shaft 21, a cylindrical holding part 43 that slidably holds the input lifter 32 inserted into the through hole 44 and a gear part 45 as an acting part on which the driving force of the electric motor 51 acts.

As for the supporting part 21*b*, a plurality, three supporting parts in this embodiment, are provided in the axial direction and at intervals with each inlet cam 21*a*, between the supporting parts and the circular supported part 42, and are slidably supported on a periphery of each cylindrical supporting part 21*b*. The axial movement of the lifter holder 41 is regulated by a pair of snap rings 46 arranged between both inlet cams 21*a* and is provided to the supporting part 21*b* in the center in the axial direction and the supported part 42. Each supported part 42 may be also supported by the supporting part 21*b* via a rolling bearing such as a needle bearing. The gear part 45 is formed by a partial worm wheel in the shape of an arc formed by a part in a circumferential direction of a worm wheel.

The driving force of the electric motor 51 attached to the head cover 3 is transmitted to the gear part 45 engaged with a driving gear 52 via the driving gear 52 configured by a worm as a driving force transmission member and is provided to a rotating shaft of the electric motor 51. The lifter holder 41 is rocked in a predetermined rocked range in which a set variation width of the maximum lift quantity is acquired with the inlet cam shaft 21 in the center. Each electric motor 51 is arranged between a pair of intake valves 13 and between a pair of exhaust valves 14 which are respectively plural engine valves provided to the cylinder head 2 when the electric motor is viewed from the cylinder axial direction. Therefore, in the axial direction, each electric motor 51 is arranged between a pair of intake valves 13 and between a pair of exhaust valves 14 and further, in the perpendicular direction, each electric motor is located between the intake valve 13 and the exhaust valve 14.

The timing variable mechanism 55 is provided with an actuator, for example, a hydraulic actuator such as a hydraulic motor, the actuator relatively rotates the inlet cam shaft 21 against each cam sprocket 29*b*, and the timing variable mechanism varies the timing of the opening and closing of the intake valve 13 without varying the maximum lift quantity and a valve open period.

The electric motor 51 and the timing variable mechanism 55 are controlled by a control unit configured by an electronic control unit based upon the operational condition of the internal combustion engine E sensed by an operational condition sensor that senses the operational condition of the engine such as engine speed and a load of the engine.

Figure 3:
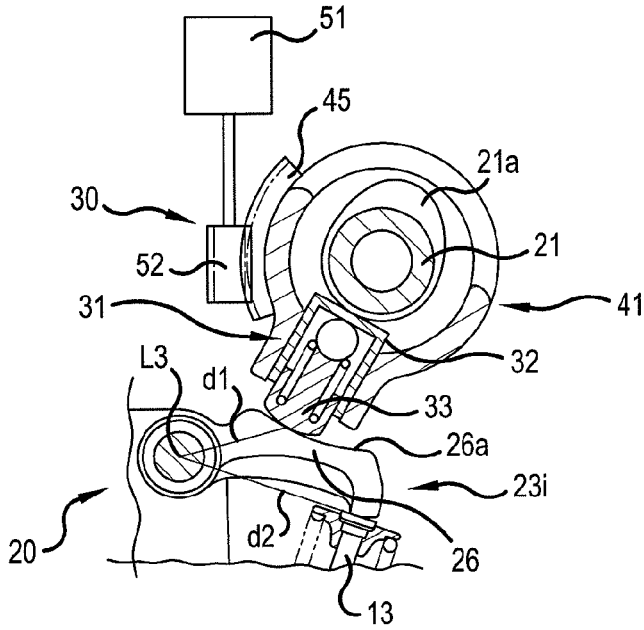
FIG. 3 is a sectional view showing the main part when large maximum lift quantity is set by a lift quantity variable mechanism of the variable valve system shown in FIG. 1.
Figure 4:
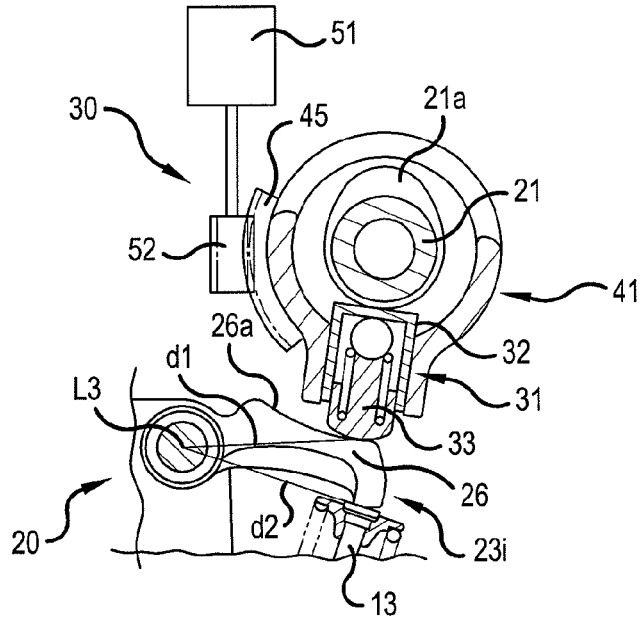
FIG. 4 is a sectional view showing the main part when small maximum lift quantity is set by the lift quantity variable mechanism of the variable valve system shown in FIG. 1.
Figure 5A:
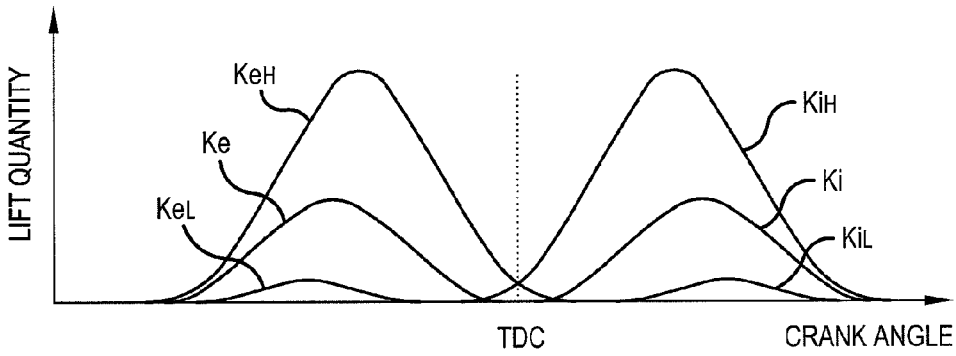
FIG. 5(*a*) is a graph showing valve operational characteristics acquired by the variable valve system shown in FIG. 1, wherein FIG. 5(*a*) shows the valve operational characteristic when maximum lift quantity is varied by the lift quantity variable mechanism.
Figure 5B:
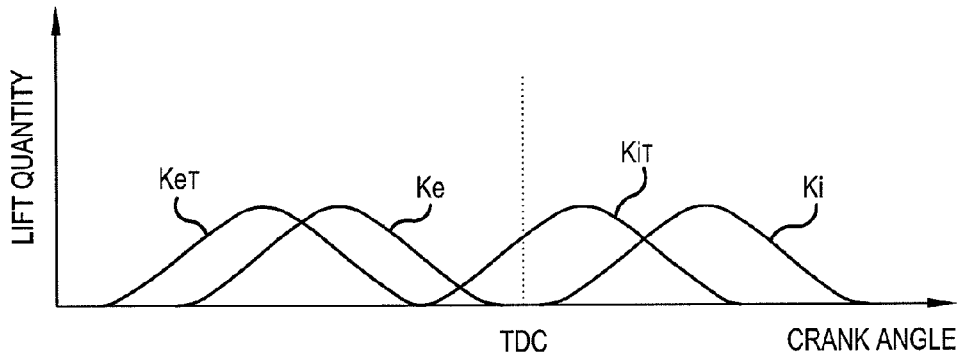

Referring to FIGS. 3 to 5(*b*), the operation of the variable valve system 20 will be described below.

For example, when only a relatively small quantity is taken in such as when the internal combustion engine E is operated at a small load, the lift quantity variable mechanism 30 is located in a position shown in FIG. 1. At this time, the intake valve 13 and the exhaust valve 14 are opened and closed according to valve operational characteristics Ki, Ke shown in FIG. 5(*a*).

When an intake amount is increased from the condition shown in FIG. 1 such as when the internal combustion engine E is operated at a large load, the electric motor 51 controlled by the control unit turns the lifter holder 41 clockwise (counterclockwise as to the lift quantity variable mechanism 30 for the exhaust valve) as shown in FIG. 3. Thus, distance d1 between the rock center line L3 and a position in which the lifter 31 abuts on the abutting part 26 varies. The ratio (hereinafter called arm ratio) of the distance d1 and distance d2 between the rock center line L3 and a position in which the valve pressing part 25 presses the intake valve 13 increases, the maximum lift quantity increases, and the intake amount taken in the combustion chamber 10 increases. At this time, the intake valve 13 and the exhaust valve 14 are opened and closed according to valve operational characteristics $Ki_H$, $Ke_H$ shown in FIG. 5(*a*). The valve operational characteristics $Ki_H$, $Ke_H$ increase in the maximum lift quantity and the valve open period, compared with the valve operational characteristics Ki, Ke. Thus, as to the intake valve 13, opening timing and maximum lifted timing (timing at which the maximum lift quantity is acquired) are advanced, closing timing is delayed. In addition, as to the exhaust valve 14, opening timing is advanced, and maximum lifted timing and closing timing are delayed.

In the meantime, when an intake amount is reduced from the condition shown in FIG. 1 such as when the internal combustion engine E is operated at an extremely small load or in idle operation, the electric motor 51 controlled by the control unit turns the lifter holder 41 counterclockwise (clockwise as to the lift quantity variable mechanism 30 for the exhaust valve) as shown in FIG. 4. Thus, the distance d1 varies, the arm ratio decreases, the maximum lift quantity decreases, and an intake amount taken in the combustion chamber 10 decreases. At this time, the intake valve 13 and the exhaust valve 14 are opened and closed according to valve operational characteristics $Ki_L$, $Ke_L$. The valve operational characteristics $Ki_L$, $Ke_L$ decrease in the maximum lift quantity and the valve open period, compared with the valve operational characteristics Ki, Ke. Thus, as to the intake valve 13, opening timing and maximum lifted timing are delayed, closing timing is advanced. In addition, as to the exhaust valve 14, opening timing is delayed, and maximum lifted timing and closing timing is advanced.

As described above, when the lifter holder 41 is rocked in the lift quantity variable mechanism 30, the lifter 31 is moved on the abutting surface 26*a*, the arm ratio continuously varies, the maximum lift quantity of the intake valve 13 continuously varies, and further, the opening/closing timing and the valve open period of the intake valve 13 continuously vary.

When the maximum lift quantity is varied by the lift quantity variable mechanism 30, the control unit operates the timing variable mechanism 55 shown in FIG. 2, and a phase of the inlet cam shaft 21 for the crankshaft 6 is continuously varied so that timing when the maximum lift quantity is acquired (a cam angle) is unchanged before and after the maximum lift quantity is varied or so that opening timing or closing timing is advanced or delayed.

Valve operational characteristics $Ki_T$, $Ke_T$ occur in which only opening/closing timing is varied without varying lift quantity and the valve open period are acquired as shown in FIG. 5(*b*) by operating the timing variable mechanism 55 in a condition that the lifter holder 41 is held in a fixed position by the electric motor 51 in the lift quantity variable mechanism 30, for example, in the condition shown in FIG. 1.

As described above, the maximum lift quantity, opening/closing timing and the valve open period are continuously varied by driving the lifter holder 41 by the electric motor 51, rocking the lifter holder in the predetermined rocked range which is a preset moving range and varying a position in which the output lifter 33 abuts on the intake rocker arm 23*i* according to a position of the lifter holder 41. A cross section in a range in which the output lifter 33 is moved on the abutting surface 26*a* by a rock of the lifter holder 41 on a plane perpendicular to a rotational center line L1 on the abutting surface 26*a* of the abutting part 26 on which the output lifter 33 abuts is in the shape of a circular arc having the rotational center line L1 in the center. Therefore, valve clearance is kept fixed in a range in which the maximum lift quantity is varied by the lift quantity variable mechanism 30.

Next, the action and the effect of the above-mentioned embodiment will be described.

The lift quantity variable mechanism 30 of the variable valve system 20 is provided with each lifter 31 that is driven by each cam 21*a*, 22*a* and applies force for driving the intake valve 13 or the exhaust valve 14 to each rocker arm 23*i*, 23*e*, and each lifter holder 41 driven and rocked by the electric motor 51. The lifter 31 is movably supported by the lifter holder 41 so that the lifter holder 41 is not moved when the lifter is moved by the valve driving force of each cam 21*a*, 22*a*, and the maximum lift quantity is varied by continuously varying a position in which the lifter 31 abuts on each rocker arm 23*i*, 23*e* according to a position of the lifter holder 41. Thus, as the lifter 31 has only to be moved on each rocker arm 23*i*, 23*e* by rocking the lifter holder 41 movably supporting the lifter 31 that abuts on each rocker arm 23*i*, 23*e* by the electric motor 51 so as to vary the maximum lift quantity of the intake valve 13 or the exhaust valve 14, the space around each cam shaft 21, 22 which is space for arranging each rocker arm 23*i*, 23*e* can be reduced, compared with a case wherein each of the entire rocker arms 23*i*, 23*e* is moved. Thus, the cylinder head 2 is miniaturized, and as a result, the internal combustion engine E is miniaturized. In addition, as the lifter holder 41 is not moved together with the lifter 31 when each lifter 31 is driven by each cam 21*a*, 22*a*, an inertial mass on the driving force transmission path from each cam 21*a*, 22*a* to each rocker arm 23*i*, 23*e* can be reduced. This is to be compared with a case wherein a member supporting the lifter is also moved together with the lifter that is moved by the force for driving the intake valve 13 or the exhaust valve 14. Thus, the responsiveness of opening and closing the intake valve 13 or the exhaust valve 14 in the high-speed operation of the internal combustion engine E is made satisfactory.

The lifter 31 is provided with the input lifter 32 that abuts on each cam 21*a*, 22*a*, the output lifter 33 abuts on each rocker arm 23*i*, 23*e* and the spring 34 that respectively presses the input lifter 32 and the output lifter 33 on each cam 21*a*, 22*a* and each rocker arm 23*i*, 23*e*, and the input lifter 32 and the output lifter 33 respectively are relatively movable in each pressed direction by the spring 34 are pressed and touched on/to each cam 21*a*, 22*a* and on/to each rocker arm 23*i*, 23*e* by the spring 34. Thus, collision between the lifter 31 and each cam 21*a*, 22*a* or each rocker arm 23*i*, 23*e* is prevented because no clearance between the lifter 31 and each cam 21*a*, 22*a* or each rocker arm 23*i*, 23*e* is formed and noise caused by the collision is prevented from being made.

As the electric motor 51 is arranged between the intake valve 13 and the exhaust valve 14 which are plural engine valves provided to one cylinder C when the electric motor is viewed in the cylinder axial direction, the cylinder head 2 is miniaturized and as a result, the internal combustion engine E is miniaturized.

Referring to FIGS. 6 to 9, a second embodiment of the invention will be described. The second embodiment is different from the first embodiment in that a variable valve system 20 is provided with a valve halt mechanism. A description of the same parts in the second embodiment is omitted or is simplified and the second embodiment will be described below with different points in the center. The same reference numerals are allocated to the same members or corresponding members as compared to the members in the first embodiment, if necessary.

Figure 6:
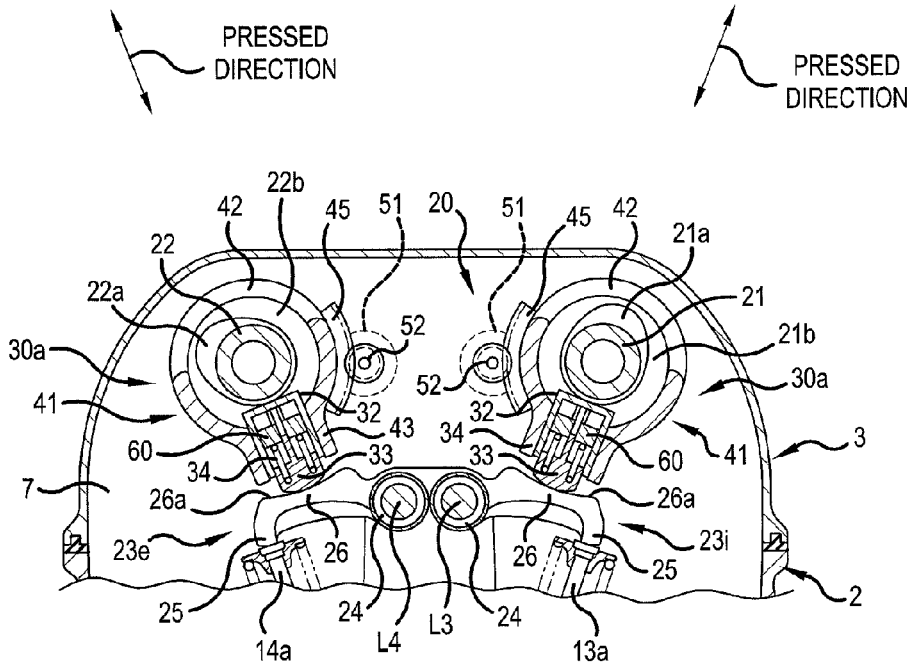
FIG. 6 shows a second embodiment of the invention and shows a main part on the similar section to that in FIG. 1.
Figure 7:
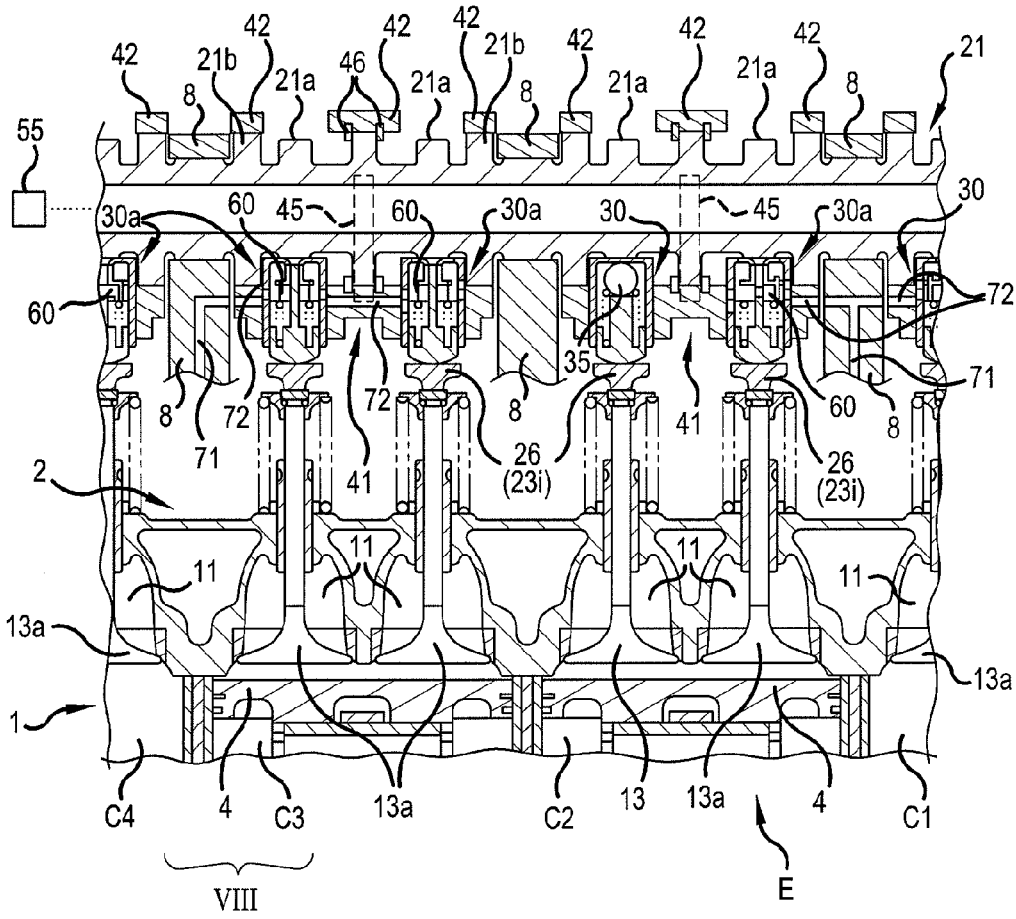
FIG. 7 shows the main part on the similar section to that in FIG. 2 of an internal combustion engine shown in FIG. 6.

Referring to FIGS. 6 and 7, an internal combustion engine E in the second embodiment is a water-cooled multi-cylinder 4-stroke internal combustion engine. The internal combustion engine E is provided with a cylinder block 1 having a plurality of cylinders each having a piston 4 that is fitted so that the piston can be reciprocated. Four cylinders C1 to C4 are arranged in line and integrated in this embodiment. A cylinder head 2 is provided with a pair of intake valves 13 that open and close an intake port 11 and a pair of exhaust valves 14 that open and close an exhaust port for every cylinder C1 to C4. In addition, each intake valve 13 and each exhaust valve 14 are driven by the variable valve system 20 for performing an opening/closing operation.

The variable valve system 20 is provided with an inlet cam shaft 21 and an exhaust cam shaft 22, an inlet cam 21*a* and an exhaust cam 22*a*, an intake rocker arm 23*i* and an exhaust rocker arm 23*e*, a lift quantity variable mechanism 30, an electric motor 51, a timing variable mechanism 55 and the valve halt mechanism 60 that halts a part 13*a* of intake valves and a part 14*a* of exhaust valves of the internal combustion engine E.

A lift quantity variable mechanism in the second embodiment is configured by the lift quantity variable mechanism 30 having the same structure as that in the first embodiment and a lift quantity variable mechanism 30*a* including the valve halt mechanism 60. The lift quantity variable mechanism 30 is provided for the intake valve 13 and the exhaust valve (not shown) respectively continuously operated when the engine valves are not halted. The lift quantity variable mechanism 30*a* is provided for the intake valve 13*a* and the exhaust valve 14*a* which can be respectively halted. The lift quantity variable mechanism 30*a* applies the same action as the lift quantity variable mechanism 30 except the action relating to the valve halt mechanism 60.

As the lift quantity variable mechanism 30*a* and the valve halt mechanism 60 for the intake valve have the same structure as those for the exhaust valve, the lift quantity variable mechanism 30*a* and the valve halt mechanism 60 for the intake valve will be mainly described below. As for the lift quantity variable mechanism 30*a* and the valve halt mechanism 60 for the exhaust valve, as in the first embodiment, the intake valve 13 and members related to its operation correspond to the exhaust valve 14 and members related to its operation.

Figure 8:
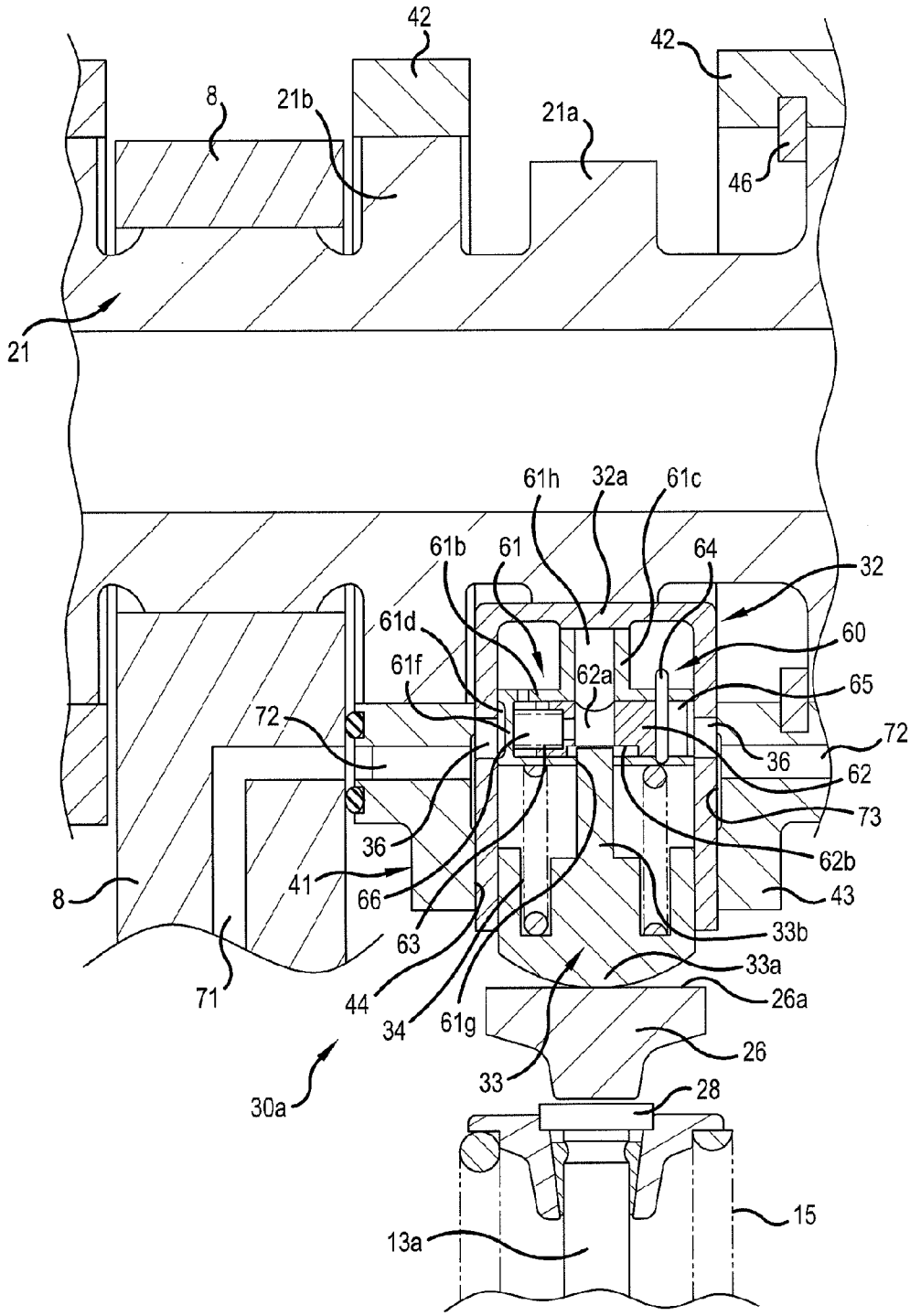
FIG. 8 is an enlarged view showing the main part in a part shown by VIII in FIG. 7.

Referring to FIG. 8, the lift quantity variable mechanism 30*a* is provided with a lifter holder 41 provided for every cylinder C1 to C4 and a lifter 31 supported by each lifter holder 41. The lifter 31 is provided with an input lifter 32 that abuts on the inlet cam 21*a*, an output lifter 33 that abuts on an abutting part 26 of the intake rocker arm 23*i*, a spring 34 and a pin holder 61 described later as a transmission element.

Each lifter holder 41 in every cylinder C1 to C4 is one member in which the lifter holder 41 of the lift quantity variable mechanism 30 and the lifter holder 41 of the lift quantity variable mechanism 30*a* are integrated.

The driving force of a pair of electric motors 51 provided corresponding to each lift quantity variable mechanism 30*a* is transmitted to a gear part 45 of each lifter holder 41 via a driving gear 52 configured by pinion gears as a driving force transmission member provided to a rotating shaft extended in parallel with the inlet camshaft 21 corresponding to each lifter holder 41 every cylinder C1, to C4, and the lifter holder 41 is rocked in the predetermined rocked range with the inlet camshaft 21 in the center.

The hydraulic valve halt mechanism 60 is provided between the input lifter 32 and the output lifter 33 in a pressed direction and transmits a valve driving force of the inlet cam 21*a* to the intake rocker arm 23*i* via the lifter 31 or disconnects the valve driving force. The valve halt mechanism 60 is operated in a specific operational condition, such as a light-load operation of the internal combustion engine E as shown in FIG. 8, for disconnecting the valve driving force to the intake rocker arm 23*i* by preventing the output lifter 33 from being moved independent of the movement of the input lifter 32 driven and reciprocated by the inlet cam 21*a*, for keeping the intake valve 13*a* closed, while the valve halt mechanism 60 is inactivated in an operational condition (that is, in a nonspecific operational condition) such as a heavy-load operation of the internal combustion engine E except the specific operational condition. Thus, the input lifter 32 transmits the valve driving force to the output lifter 33 via the valve halt mechanism 60, the intake valve 21*a* drives the intake rocker arm 23*i* via the lifter 31, and the rocked intake rocker arm 23*i* opens and closes the intake valve 13*a*.

In the internal combustion engine E in which a part of the cylinders can be halted, in each cylinder C1, C2 continuously operated, a part of intake valves is the intake valve 13*a*, a part of exhaust valves is the exhaust valve 14*a*, and in each cylinder C3, C4 which can be halted, all the intake valves and all the exhaust valves are the intake valves 13*a* and the exhaust valves 14*a*.

Figure 9:
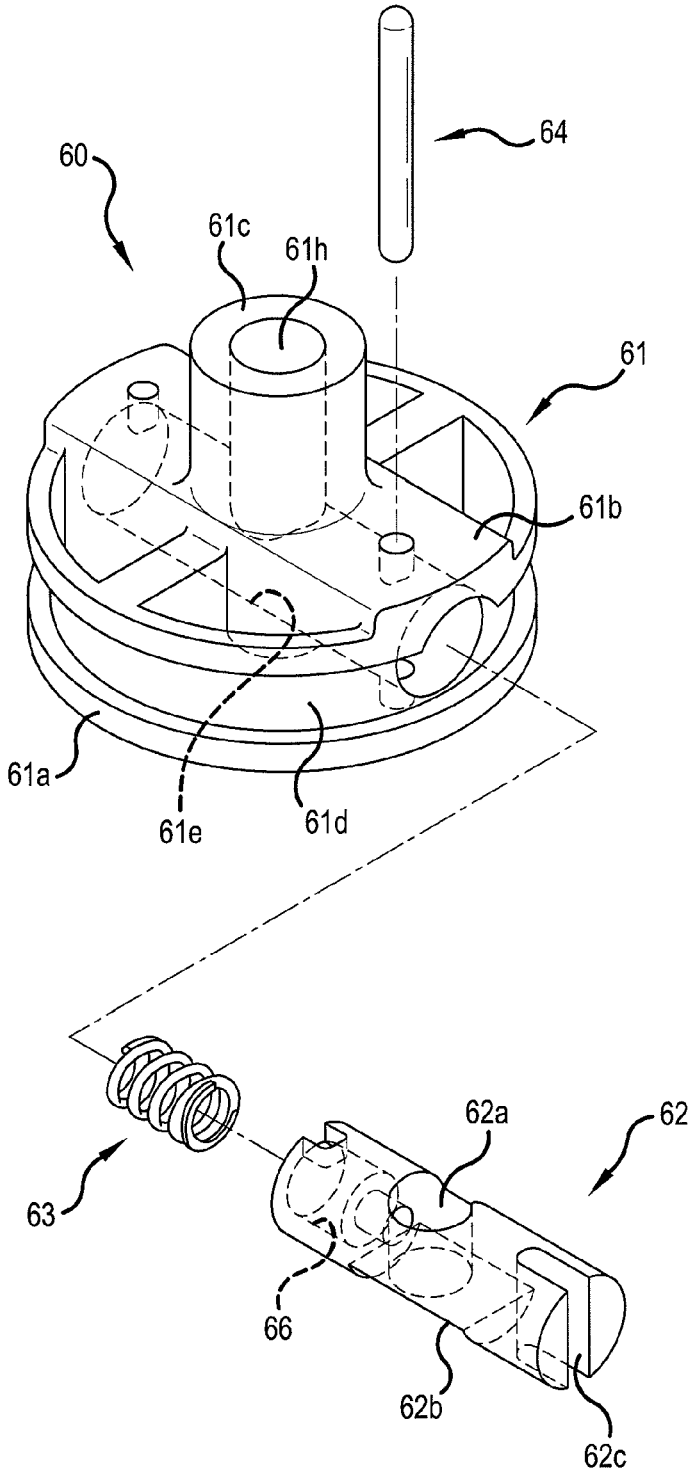
FIG. 9 is an exploded perspective view showing a valve halt mechanism of a variable valve system in the internal combustion engine shown in FIG. 6.

Referring to FIGS. 8 and 9, the valve halt mechanism 60 provided to the lifter holder 41 and built in the input lifter 32 is provided with the cylindrical pin holder 61 slidably fitted inside the input lifter 32, a slide pin 62 fitted into the pin holder 61 so that the slide pin can be reciprocated, a return spring 63 that presses the slide pin 62 reciprocated by the oil pressure of working fluid and a stopper pin 64 for preventing the axial rotation of the slide pin 62.

The pin holder 61 is a member in which a ring part 61*a* touched to an inside face of the input lifter 32 with a coupling part 61*b* that couples the ring part 61*a* in a direction of a diameter and a cylindrical pressing part 61*c* that projects from the center of the coupling part 61*b* upwardly, abuts on a top wall 32*a* and presses the top wall 32*a*. An annular oil channel 61*d* is formed all around on a periphery of the ring part 61*a*. In the coupling part 61*b*, a housing hole 61*e* having a bottom provided with an open end having an axis perpendicular to an axis of the input lifter 32 (this axis is parallel to the pressed direction) is open to the oil channel 61*d* and a closed end is closed by a bottom wall 61*f*. A through hole 61*g* is provided into which a cylindrical projection 33*b* is an abutting part provided to the output lifter 33 that can be inserted and which is open to the housing hole 61*e*. In the pressing part 61*c*, a through hole 61*h* is formed into which the projection 33*b* can be inserted and which is open to the housing hole 61*e*.

In the pin holder 61, a hydraulic chamber 65 communicating with the oil channel 61*d* is formed between the slide pin 62 and the input lifter 32, and a spring chamber 66 housing the return spring 63 for pressing the slide pin 62 in a direction in which the volume of the hydraulic chamber 65 decreases is formed between the slide pin 62 and the bottom wall 61*f*. The spring 34 provided between the ring part 61*a* and the output lifter 33 presses the input lifter 32 via the pin holder 61 so that the input lifter 32 abuts on the inlet cam 21*a*. Further, an annular oil channel 73 is formed all around on an inside face of a holding part 43 having a through hole 44 of the lifter holder 41 and the oil channel 73 constantly communicates with the oil channel 61*d* via an oil channel 36 provided to the input lifter 32.

A through hole 62*a* in which the projection 33*b* can pierce and which can be coaxial with both through holes 61*g*, 61*h* is provided to the slide pin 62. The through hole 62*a* is open to a flat abutting surface 62*b* formed on the periphery of the slide pin 62 on the side of the through hole 61*g* and opposite to the through hole 61*g*. The abutting surface 62*b* is formed to be longer than a diameter of the through hole 61*g* in an axial direction of the slide pin 62 and the through hole 61*g* is open to the abutting surface 62*b* close to the return spring 63.

When the oil pressure of the hydraulic chamber 65 to which working fluid is supplied decreases, the slide pin 62 is turned in a valve halt position shown in FIG. 8 in which the projection 33*b* can be inserted into the through hole 62*a* by the resilient force of the return spring 63. When the oil pressure of the hydraulic chamber 65 increases, the through hole 62*a* is off the through holes 61*g*, 61*h* by the oil pressure and the slide pin 62 is turned in a valve operated position in which the projection 33*b* abuts on the abutting surface 62*b*.

The stopper pin 64 is press-fitted into the pin holder 61 on the side of an open end of the housing hole 61*e* and pierces a slit 62*c* open to the hydraulic chamber 65 and provided to the slide pin 62. Therefore, the stopper pin 64 allows the movement in the axial direction of the slide pin 62 and regulates the maximum movement to the side of the hydraulic chamber 65 of the slide pin 62 by abutting on a bottom wall of the slit 62*c*.

When the slide pin 62 is located in the valve halt position, the lifter 31 is slid by the valve driving force which acts from the inlet cam 21*a*, and the pin holder 61 and the slide pin 62 are moved toward the intake rocker arm 23*i* together with the input lifter 32, however, as the projection 33*b* enters the through hole 62*a* and the through hole 61*h*, the valve driving force does not act on the intake rocker arm 23*i*, and as the intake rocker arm 23*i* is not rocked, the intake valve 13 is kept closed and is halted.

As the projection 33*b* abuts on the abutting surface 62*b* of the slide pin 62 and the valve driving force of the inlet cam 21*a* is transmitted to the output lifter 33 via the input lifter 32, the pin holder 61 and the slide pin 62, when the slide pin 62 is located in the valve operated position, the inlet cam 21*a* opens and closes the intake valve 13 via the intake rocker arm 23*i*.

As described above, the valve halt mechanism 60 transmits or disconnects the valve driving force between the input lifter 32 and the output lifter 33 and switches an operated condition and a halted condition of the intake valve 13 without varying a position of the lifter holder 41.

A hydraulic control system that supplies and discharges working fluid to/from each valve halt mechanism 60 is provided with a plurality of hydraulic control valves (not shown) for controlling the oil pressure of the working fluid supplied to each valve halt mechanism 60 and an oil channel system that conducts the working fluid controlled by the hydraulic control valve to each valve halt mechanism 60. Each hydraulic control valve is controlled by the above-mentioned control unit for controlling the oil pressure of the working fluid so that the oil pressure of the hydraulic chamber 65 of the valve halt mechanism 60 of each cylinder C1 to C4 is low or high. The oil channel system is provided with an oil channel 71 provided to a cam holder 8 that supports both cam shafts 21, 22 and an oil channel 72 provided to the lifter holder 41.

Owing to the variable valve system, the internal combustion engine E can be operated in the following operational situations for example, that is, in an operational situation in which all the intake valves 13, 13*a* and all the exhaust valves 14, 14*a* are operated in all the cylinders C1 to C4, in an operational situation in which only the cylinder C4 is halted, and in an operational situation in which the cylinders C3, C4 are halted, according to an operated condition and an inactivated condition of each valve halt mechanism 60. As the intake valve 13*a* and the exhaust valve 14*a* are halted in the operated cylinders C1, C2 when the cylinders C3, C4 are halted, intake air from the operated intake valve 13 forms a swirl flow, flows into a combustion chamber 10, and flammability is enhanced.

As switching between an operating condition and a halted condition of the intake valve 13*a* is made by the valve halt mechanism 60 independent of the setting of maximum lift quantity by the lift quantity variable mechanism 30*a*, the intake valve 13*a* operated at an arbitrary maximum lift quantity can be promptly halted.

According to the second embodiment, similar actions and effects to those in the first embodiment are produced and in addition, the following actions and effects are produced.

The variable valve system 20 is provided with the valve halt mechanism 60 that halts the intake valve 13*a* (or the exhaust valve 14*a*) without varying a position of the lifter holder 41. As the valve halt mechanism 60 halts the intake valve 13*a* (or the exhaust valve 14*a*) without moving the lifter holder 41, therefore, without varying the maximum lift quantity continuously set according to a position in which the lifter holder 41 is rocked because the lift quantity variable mechanism 30*a* can continuously vary the maximum lift quantity, the setting of the maximum lift quantity by the lift quantity variable mechanism 30*a* and the switching between the operated condition and the halted condition of the intake valve 13*a* (or the exhaust valve 14*a*) by the valve halt mechanism 60 can be independently executed. In addition, the switching between the operated condition and the halted condition of the intake valve 13*a* (or the exhaust valve 14*a*) is always promptly executed independent of the maximum lift quantity of the intake valve 13*a* (or the exhaust valve 14*a*).

As the valve halt mechanism 60 is built in the lifter 31 by transmitting and disconnecting the valve driving force between the input lifter 32 and the output lifter 33, the valve halt mechanism 60 can be provided without making the structure of the rocker arms 23*i*, 23*e* intricate.

Figure 10:
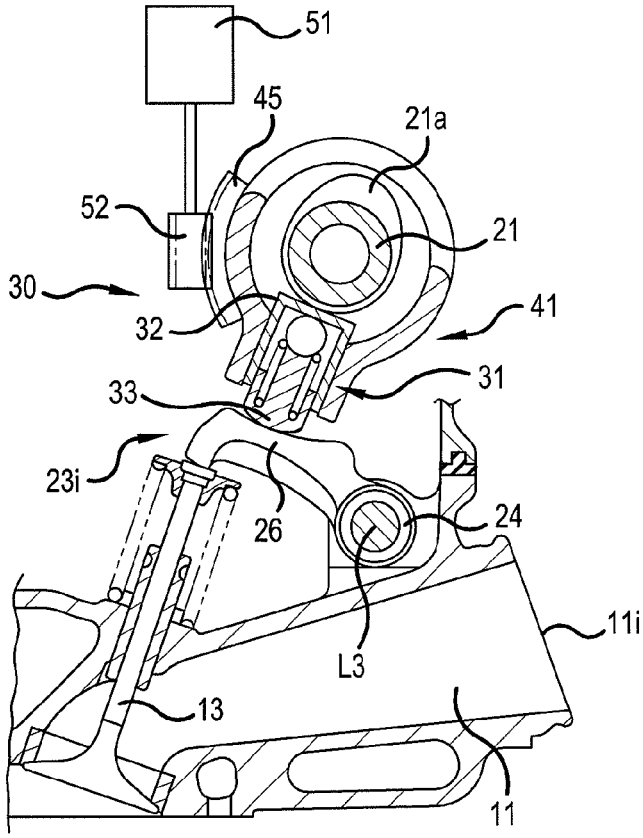
FIG. 10 shows a third embodiment of the invention and shows a main part on the similar section to that in FIG. 1.

Referring to FIG. 10, a third embodiment of the invention will be described below. The third embodiment is different from the first embodiment mainly in the arrangement of an intake rocker arm and an exhaust rocker arm. The remainder of the third embodiment is basically the same configuration as the first embodiment.

More specifically, a fulcrum 24 of the intake rocker arm 23*i* is provided close to an inlet 11*i* of an intake port 11 on the reverse side to a cylinder axis Lc (see FIG. 1) with an intake valve 13 between the cylinder axis and the fulcrum in a perpendicular direction. Similarly, a fulcrum of the exhaust rocker arm is provided close to an outlet of an exhaust port on the reverse side to the cylinder axis Lc with an exhaust valve between the cylinder axis and the fulcrum in the perpendicular direction.

Next, referring to FIGS. 11 to 15, a fourth embodiment to a seventh embodiment of the invention will be described. In the fourth embodiment to the seventh embodiment, a lift quantity variable mechanism for an intake valve and an actuator are described, however, the lift quantity variable mechanism and the actuator may be also used for an exhaust valve.

Figure 11:
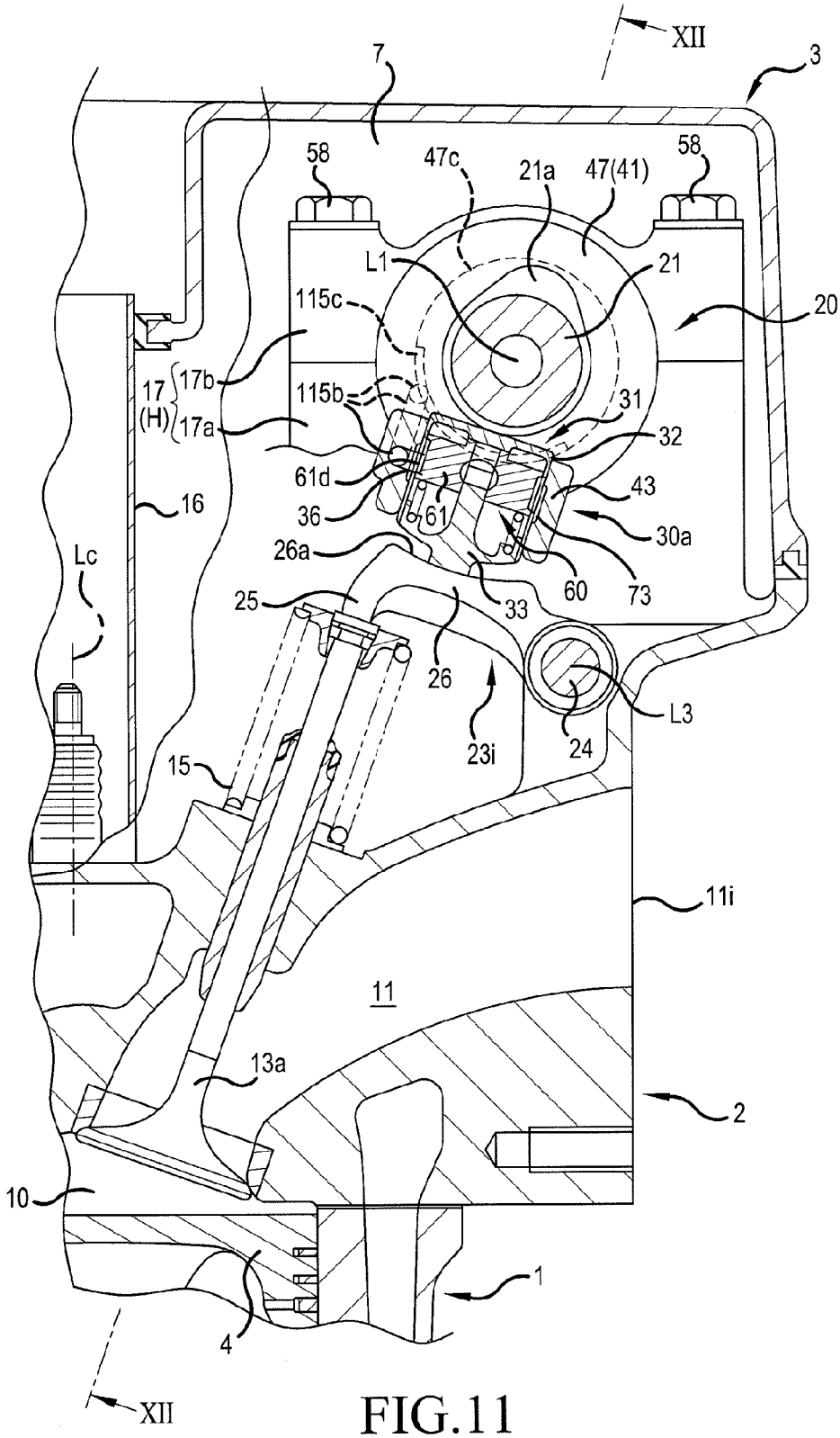
FIG. 11 shows a fourth embodiment of the invention and shows a main part on the similar section to that in FIG. 1.
Figure 12:
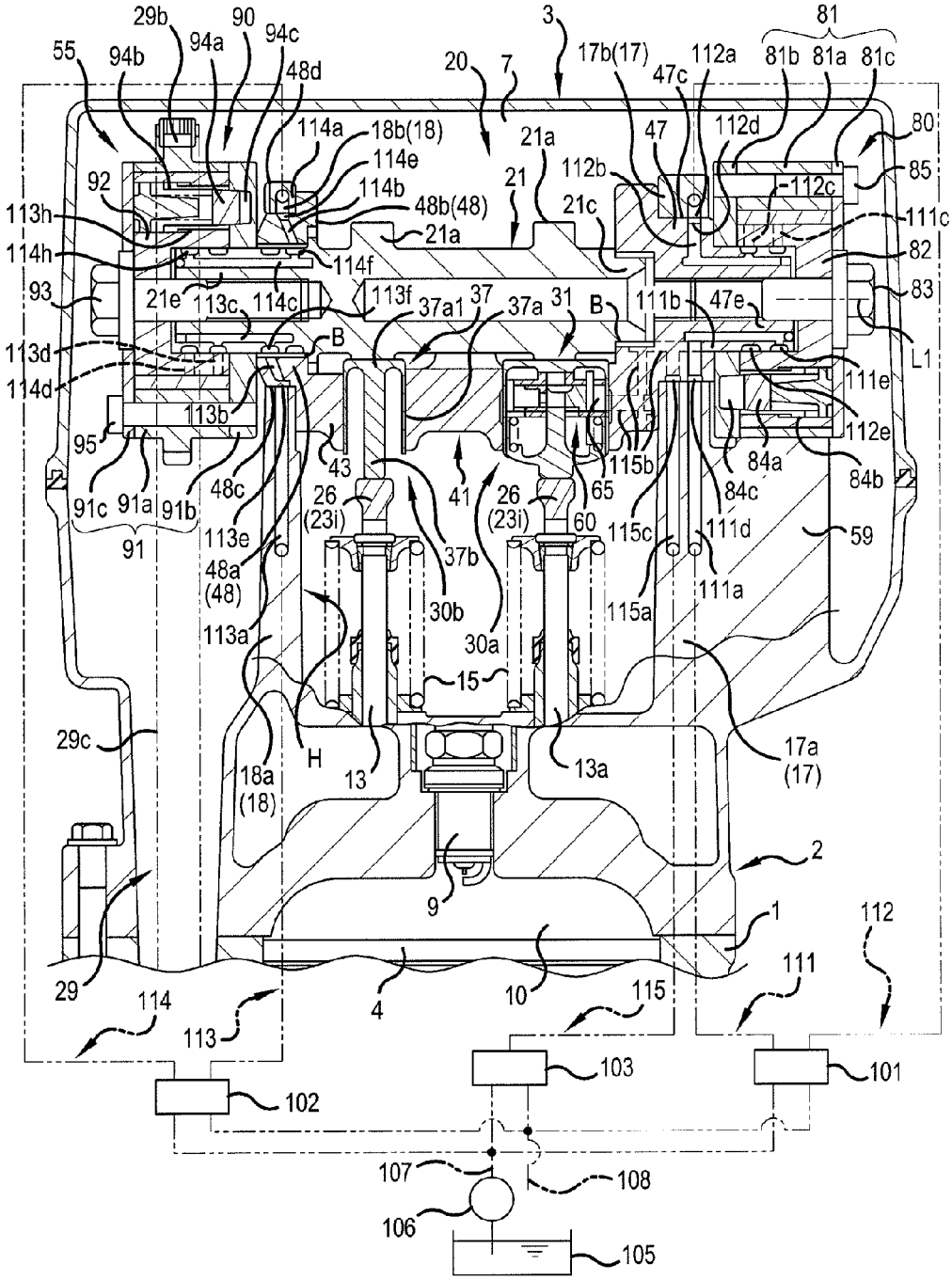
FIG. 12 is a sectional view viewed substantially along a line XII-XII in FIG. 11.

Referring to FIGS. 11 and 12, the fourth embodiment will be described below.

The fourth embodiment is different from the second embodiment mainly with respect to the internal combustion engine E having only a single cylinder and with respect to the structure of an actuator and a lifter holder of a variable valve system 20. The other features of the fourth embodiment are basically the same configuration as the second embodiment. Therefore, the description of the same parts is omitted or simplified and the different parts will be mainly described below. The same reference numerals are used for the same members as that in the first and second embodiments or corresponding members if necessary.

In the fourth embodiment, an internal combustion engine E is a single-cylinder 4-stroke internal combustion engine with a spark plug 9 opposite to the center of a combustion chamber 10 being arranged substantially in parallel with the cylinder axis Lc in a housing cylinder 16 provided so that the housing cylinder surrounds the cylinder axis Lc. In the internal combustion engine E, a fulcrum 24 of an intake rocker arm 23*i* is arranged close of an inlet 11*i* of an intake port 11 on the reverse side to the cylinder axis Lc and the spark plug 9 with an intake valve 13*a* disposed between the cylinder axis and the fulcrum is arranged in a perpendicular direction in which an axial direction of the fulcrum is perpendicular to the cylinder axis Lc. An exhaust rocker arm is also arranged as in the third embodiment and the spark plug 9 is arranged in the center of the combustion chamber 10, the intake rocker arm 23*i* and the exhaust rocker arm are compactly arranged without a constraint on the arrangement of the spark plug 9. Thus, a variable valve system 20 is made to be compact.

The variable valve system 20 is provided with an inlet camshaft 21, an inlet cam 21*a*, an intake rocker arm 23*i*, lift quantity variable mechanisms 30*a*, 30*b*, a first hydraulic actuator 80 as an actuator that drives a lifter holder 41 of the lift quantity variable mechanisms 30*a*, 30*b*, a timing variable mechanism 55 and a valve halt mechanism 60 that turns a part of intake valves 13*a* of the internal combustion engine E in a halted condition. The timing variable mechanism 55 is provided with a second hydraulic actuator 90 as an actuator that relatively turns the inlet camshaft 21 with a cam sprocket 29*b*.

The inlet camshaft 21 is rotatably supported by a cam holder H provided to a cylinder head 2. The cam holder H is provided with first and second bearings 17, 18 that rotatably support one end 21*c* and the other end 21*e* which are both a part of the inlet camshaft 21. The first and second bearings 17, 18 are end bearings which are bearings located at both ends of the cam holder H in their axial direction and are configured by lower bearing parts 17*a*, 18*a* integrated with the cylinder head 2 and upper bearing parts 17*b*, 18*b* connected to the lower bearing parts 17*a*, 18*a* by each bolt 58.

The lift quantity variable mechanisms 30*a*, 30*b* are the lift quantity variable mechanism 30*b* that normally operates the intake valve 13 and the lift quantity variable mechanism 30*a* in which the valve halt mechanism 60 is built as in the second embodiment. Both lift quantity variable mechanisms 30*a*, 30*b* are provided with the common lifter holder 41 as in the second embodiment. A lifter 37 of the lift quantity variable mechanism 30*b* is supported reciprocatably in a radial direction by the lifter holder 41. The lifter 37 is provided with an input lifter 37*a* made of a cylindrical member having a top wall 37*a*1 abutting on the inlet cam 21*a* as an abutting part, fitted to a holding part 43 and slidably supported by the lifter holder 4 and a rod output lifter 37*b* extending downwardly from the top wall 37*a*1 and abutting on an abutting part 26 of the intake rocker arm 23*i* as an abutting part. The input lifter 37*a* and the output lifter 37*b* are integrated.

One lifter holder 41 that holds both lifters 31, 37 is rockably supported by the cam holder H for rotatably supporting the inlet camshaft 21. The lifter holder 41 is provided with a first supported part 47 that rotatably supports one end 21*c* via a bearing B and is supported by the first bearing 17 and a second supported part 48 that rotatably supports the other end 21*e* via a bearing B and is supported by the second bearing 18. Therefore, the inlet camshaft 21 is rotatably supported by the cam holder H via the lifter holder 41. As the first and second supported parts 47, 48 are provided with all lifters 31, 37 between the supported parts in the axial direction, they also function as both ends of the lifter holder 41.

The first supported part 47 is provided with a peripheral face 47*c* slidably touched to the first bearing 17 and a connecting part 47*e* as a fitting part having an outside diameter smaller than an inner circumference of the first bearing 17 and configured by a projection connected to the actuator 80.

The second supported part 48 having a half divided structure is formed by a first half 48*a* integrated with the holding part 43 and a second half 48*b* connected to the first half 48*a* in a state in which the movement in the axial direction is regulated by a fitting structure such as a concave or convex structure. Both halves 48*a*, 48*b* are provided with peripheries 48*c*, 48*d* slidably touching on the second bearing 18.

Each actuator 80, 90 arranged in a valve chamber 7 is provided with a similar structure to that of the hydraulic actuator in JP-A No. 2000-227033.

The actuator 80 that drives and rocks the lifter holder 41 is arranged close to one end 21*c* of the inlet camshaft 21 in its axial direction and is attached on a mounting seat 59 integrated with the lower bearing part 17*a* in the vicinity of the first bearing 17. The actuator 80 is provided with a housing 81 fixed on the mounting seat 59 by a bolt (not shown), a rotor 82 is rockably housed in the housing 81 and is connected to the connecting part 47*e* by a bolt 83 and a lock pin 84*a* that blocks the turning of the rotor 82 in relation to the housing 81. Therefore, the actuator 80 is attached to the first bearing 17 via the mounting seat 59.

The housing 81 is formed by a cylindrical wall 81*a* and a pair of end walls 81*b*, 81*c* connected to the cylindrical wall 81*a* by a bolt 85. The rotor 82 is provided with the same number of vanes (not shown) arranged in a plurality of concave portions provided to an inner circumference of the cylindrical wall 81*a* and each vane forms a high lift hydraulic chamber and a low lift hydraulic chamber on both sides in a rocked direction in cooperation with the concave portion.

The lock pin 84*a* is located in a position shown by a two-dot chain line in FIG. 12 that blocks the relative turning of the rotor 82 to the housing 81 when the high lift hydraulic chamber has a maximum volume and when high-pressure hydraulic fluid is not supplied to the high lift hydraulic chamber, in the meantime, backs out of a hydraulic chamber 84*c* as shown by a full line in FIG. 12, and allows the turning of the rotor 82 in relation to the housing 81 when high-pressure hydraulic fluid is supplied to the high lift hydraulic chamber and oil pressure in the hydraulic chamber 84*c* for releasing the locking that communicates with the high lift hydraulic chamber via an oil passage (not shown) when it exceeds the pressure of a spring 84*b*.

The actuator 90 that drives and turns the inlet camshaft 21 is attached to the other end 21*e* in the vicinity of the second bearing 18. The actuator 90 is provided with a housing 91 to which the cam sprocket 29*b* is provided. A rotor 92 is rockably housed in the housing 91 and is connected to the other end 21*e* by a bolt 93 and a lock pin 94*a* that blocks the turning of the rotor 92 in relation to the housing 91.

The housing 91 is formed by a cylindrical wall 91*a* and a pair of end walls 91*b*, 91*c* connected to the cylindrical wall by a bolt 95. The rotor 92 is provided with the same number of vanes (not shown) arranged in a plurality of concave portions (not shown) provided on an inner circumference of the cylindrical wall 91*a* and each vane forms a lag hydraulic chamber and an advance hydraulic chamber on both sides in the rocked direction in cooperation with the concave portion.

The lock pin 94*a* is located in a position shown by a full line in FIG. 12 and blocks the relative turning of the housing 91 and the rotor 92 when the lag hydraulic chamber has a maximum volume and high-pressure hydraulic fluid is not supplied to the lag hydraulic chamber, in the meantime, backs out of a hydraulic chamber 94*c*, and allows a rocking of the rotor 92 in relation to the housing 91 when high-pressure hydraulic fluid is supplied to the lag hydraulic chamber and oil pressure in the hydraulic chamber for releasing the locking 94*c* that communicates with the lag hydraulic chamber via an oil passage (not shown) exceeds the pressure of a spring 94*b*.

A hydraulic control system that supplies and discharges hydraulic fluid to/from both actuators 80, 90 and the valve halt mechanism 60 is provided with hydraulic control valves 101, 102, 103 that control the oil pressure of both actuators 80, 90 and the valve halt mechanism 60 and an oil passage system that leads hydraulic fluid for operating each actuator 80, 90 and the valve halt mechanism 60 via each hydraulic control valve 101, 102, 103. The hydraulic fluid is oil in an oil pan 105 as a hydraulic fluid source of the internal combustion engine E.

The three hydraulic control valves 101, 102, 103 controlled by the controller in the second embodiment control the oil pressure of the high lift hydraulic chamber and the low lift hydraulic chamber of the actuator 80, the oil pressure of the lag hydraulic chamber and the advance hydraulic chamber of the actuator 90 and the oil pressure of a hydraulic chamber 65 of the valve halt mechanism 60.

The oil passage system is provided with an oil supply passage 107 where high-pressure hydraulic fluid discharged from an oil pump 106 which is driven by the power of the internal combustion engine E and which is a component of a lubricating system of the internal combustion engine E exists. An oil exhaust passage 108 is provided for exhausting hydraulic fluid from the high lift hydraulic chamber, the low lift hydraulic chamber, the lag hydraulic chamber, the advance hydraulic chamber and the hydraulic chamber 65 with an oil passage 111 for a high lift, an oil passage 112 for a low lift, an oil passage 113 for a lag, an oil passage 114 for an advance and an oil passage 115 for a halt.

The oil passage 111 for a high lift that communicates with the high lift hydraulic chamber and the oil passage 112 for a low lift that communicates with the low lift hydraulic chamber are provided across the first bearing 17 and across the first supported part 47.

The oil passage 111 for a high lift is provided with an oil passage 111*a* provided to the lower bearing part 17*a* and for communicating with the hydraulic control valve 101, an oil passage 111*b* provided to the first supported part 47, an oil passage 111*c* provided to the rotor 82 and open to the high lift hydraulic chamber, an oil passage 111*d* which is a groove in the shape of a circular arc provided to the periphery 47*c* and which makes both oil passages 111*a*, 111*b* communicate and an oil passage 111*e* which is an annular groove provided to a periphery of the connecting part 47*e* and which makes both oil passages 111*b*, 111*c* communicate.

The oil passage 112 for a low lift is provided with an oil passage 112*a* provided to the upper bearing part 17*b* and for communicating with the hydraulic control valve 101, an oil passage 112*b* provided to the first supported part 47, an oil passage 112*c* provided to the rotor 82 and open to the low lift hydraulic chamber, an oil passage 112*d* which is a groove in the shape of a circular arc provided to the periphery 47*c* and which makes both oil passages 112*a*, 112*b* communicate and an oil passage 112*e* which is an annular groove provided to the periphery of the connecting part 47*e* and which makes both oil passages 112*b*, 112*c* communicate.

The oil passages 111*b*, 111*d*, 111*e* are provided to the first supported part 47 of the lifter holder 41, make the oil passage 111*a* and the high lift hydraulic chamber of the actuator 80 communicate, and hydraulic fluid is led to the oil passages. Similarly, the oil passages 112*b*, 112*d*, 112*e* are provided to the first supported part 47 of the lifter holder 41, make the oil passage 112*a* and the low lift hydraulic chamber of the actuator 80 communicate, and hydraulic fluid is led to the oil passages.

When the hydraulic control valve 101 makes the oil supply passage 107 and the oil passage 111 for a high lift communicate and simultaneously, makes the oil exhaust passage 108 and the oil passage 112 for a low lift communicate, hydraulic fluid is supplied to the high lift hydraulic chamber, simultaneously, hydraulic fluid in the low lift hydraulic chamber is exhausted, the actuator 80 turns the lifter holder 41 in one rocked direction, when desired maximum lift quantity is set, the hydraulic control valve 101 closes the oil passage 111 for a high lift and the oil passage 112 for a low lift, and the intake valves 13, 13*a* are opened and closed in a state in which the maximum lift quantity is increased.

In the meantime, when the hydraulic control valve 101 makes the oil supply passage 107 and the oil passage 112 for a high lift communicate and simultaneously, makes the oil exhaust passage 108 and the oil passage 111 for a high lift communicate, hydraulic fluid is supplied to the low lift hydraulic chamber, simultaneously, hydraulic fluid in the high lift hydraulic chamber is exhausted, the actuator 80 turns the lifter holder 41 in the other rocked direction, when desired maximum lift quantity is set, the hydraulic control valve 101 closes the oil passage 111 for a high lift and the oil passage 112 for a high lift, and the intake valves 13, 13*a* are opened and closed in a state in which the maximum lift quantity is decreases.

As described above, the oil pressure of the high lift hydraulic chamber and the low lift hydraulic chamber is controlled by supplying and exhausting hydraulic fluid to/from the actuator 80 and the maximum lift quantity of the intake valves 13, 13*a* is continuously varied.

The oil passage 113 for a high lift that communicates with the lag hydraulic chamber and an oil passage for an advance 114 that communicates with the advance hydraulic chamber are provided across the second bearing 18 and across the second supported part 48.

The oil passage 113 for a high lift is provided with an oil passage 113*a* provided to the lower bearing part 18*a* and communicating with the hydraulic control valve 102, an oil passage 113*b* provided to the first half 48*a*, an oil passage 113*c* provided to the other end 21*e*, an oil passage 113*d* provided to the rotor 92 and open to the lag hydraulic chamber, an oil passage 113*e* which is a groove in the shape of a circular arc provided to the periphery 48*c* and which makes both oil passages 113*a*, 113*b* communicate, an oil passage 113*f* which is an annular groove provided to a periphery of the other end 21*e* and which makes both oil passages 113*b*, 113*c* communicate via a hole provided to the bearing B and an oil passage 113*h* which is an annular groove provided to the periphery of the other end 21*e* and which makes both oil passages 113*c*, 113*d* communicate.

The oil passage for an advance 114 is provided with an oil passage 114*a* provided to the upper bearing part 18*b* and communicating with the hydraulic control valve 102, an oil passage 114*b* provided to the second half 48*b*, an oil passage 114*c* provided to the other end 21*e*, an oil passage 114*d* provided to the rotor 92 and open to the advance hydraulic chamber, an oil passage 114*e* which is a groove in the shape of a circular arc provided to the periphery 48*d* and which makes both oil passages 114*a*, 114*b* communicate, an oil passage 114*f* which is an annular groove provided to the periphery of the other end 21*e* and which makes both oil passages 114*b*, 114*c* communicate via a hole provided to the bearing B and an oil passage 114*h* which is an annular groove provided to the periphery of the other end 21*e* and which makes both oil passages 114*c*, 114*d* communicate.

When the hydraulic control valve 102 makes the oil supply passage 107 and the oil passage 113 for a high lift communicate and simultaneously, makes the oil exhaust passage 108 and the oil passage for an advance 114 communicate, hydraulic fluid is supplied to the lag hydraulic chamber, simultaneously, hydraulic fluid in the advance hydraulic chamber is exhausted, and the actuator 90 relatively turns the inlet camshaft 21 to the cam sprocket 29*b* in a reverse direction to a rotational direction of the inlet camshaft. When a desired phase of the inlet camshaft 21 is set, the hydraulic control valve 102 closes the oil passage 113 for a high lift and the oil passage for an advance 114, and the intake valves 13, 13*a* are opened and closed in a state in which the phase is more lagged.

In the meantime, when the hydraulic control valve 102 makes the oil supply passage 107 and the oil passage for an advance 114 communicate and simultaneously, makes the oil exhaust passage 108 and the oil passage 113 for a high lift communicate, hydraulic fluid is supplied to the advance hydraulic chamber, simultaneously, hydraulic fluid in the lag hydraulic chamber is exhausted, and the actuator 90 relatively turns the inlet camshaft 21 to the cam sprocket 29*b* in the rotational direction of the inlet camshaft. When a desired phase is set, the hydraulic control valve 102 closes the oil passage 113 for a high lift and the oil passage for an advance 114 and the intake valves 13, 13*a* are opened and closed in a state in which the phase more advances.

The oil pressure of the lag hydraulic chamber and the advance hydraulic chamber is controlled by supplying and exhausting hydraulic fluid to/from the actuator 90 as described above, a phase of the inlet camshaft 21 with the crankshaft 6 (see FIG. 2) is continuously varied, and the opening and closing timing of the intake valves 13, 13*a* is continuously varied.

An oil passage for a halt 115 that communicates with the hydraulic chamber 65 is provided across the first bearing 17 and across the lifter holder 41.

The oil passage for a halt 115 is provided with an oil passage 115*a* provided to the lower bearing part 17*a* and communicating with the hydraulic control valve 103, an oil passage 115*b* provided to the lifter holder 41 and an oil passage 115*c* which is a groove in the shape of a circular arc provided to the periphery 47*c* and which makes both oil passages 115*a*, 115*b* communicate. The oil passage 115*b* communicates with the hydraulic chamber 65 via an oil passage 73 provided to the holding part 43, an oil passage 36 provided to the lifter 31 and an oil passage 61*d* provided to a pin holder 61.

In a specific operational condition such as light-load operation of the internal combustion engine E, the intake valve 13*a* is closed by the valve halt mechanism 60 and in the meantime, the normally operated intake valve 13 is opened and closed by the inlet cam 21*a* via the lifter 37 and the intake rocker arm 23*i*. In the meantime, in an unspecific operational condition such as heavy-load operation of the internal combustion engine E, an input lifter 32 transmits the valve driving force of the inlet cam 21*a* to an output lifter 33 via the valve halt mechanism 60, the intake valve 13*a* is opened and closed by the inlet cam 21*a* via the lifter 31 and the intake rocker arm 23*i*, and the intake valve 13 is also opened and closed by the inlet cam 21*a* via the lifter 37 and the intake rocker arm 23*i*.

According to the fourth embodiment, except that the actuator that drives the lift quantity variable mechanisms 30*a*, 30*b* is the hydraulic actuator 80, a similar action and effect to those of each cylinder C1, C2 in the first embodiment and in the second embodiment are produced. In addition, the following actions and effects are produced.

As the inlet camshaft 21 is rotatably supported by the cam holder H via the lifter holder 41 rockably supported by the intake camshaft 21, a part for supporting the lifter holder 41 is not required to be provided to the inlet camshaft 21 or parts for supporting both the inlet camshaft 21 and the lifter holder 41 are not required to be provided to the cam holder H alongside in its axial direction, and the length of the inlet camshaft 21 can be reduced. As a result, the variable valve system 20 provided with the lifter holder 41 can be miniaturized in the axial direction of the inlet camshaft 21 and in the cylinder head 2 which is a part of the body of the engine where the inlet camshaft 21 is provided. Thus, the internal combustion engine E can be miniaturized in its axial direction.

As the inlet camshaft 21 is rotatably supported by the cam holder H, one end 21*c* and the other end 21*e* of the inlet camshaft 21 are rotatably supported by the first and second bearings 17, 18 of the cam holder H. The hydraulic actuator 80 is attached to the first bearing 17 via the mounting seat 59 and the oil passages 111*a*, 112*a* that leads hydraulic fluid for operating the actuator 80 that drives the lift quantity variable mechanisms 30*a*, 30*b* that are provided to the first bearing 17 to which the actuator 80 is attached. Thus, the intricacy of oil passage structure for the actuator 80 is avoided. The actuator 80 can be arranged close to the first bearing 17 in its axial direction and the actuator 80 can be arranged compactly in the axial direction. Thus, the cylinder head 2 can be miniaturized.

As one end 21*c* is rotatably supported by the first bearing 17 via the lifter holder 41 rockably supported by the first bearing 17, the oil passages 111*b*, 111*d*, 111*e*; 112*b*, 112*d*, 112*e* which make the oil passages 111*a*, 112*a* and the actuator 80 communicate and in which hydraulic fluid for operating the actuator 80 is led are provided in the first supported part 47 of the lifter holder 41 arranged between the inlet camshaft 21 and the bearing 17. In addition, the oil passages 111*b*, 111*d*, 111*e*; 112*b*, 112*d*, 112*e* can be provided inside the first bearing 17 in a radial direction. Thus, the actuator 80 can be miniaturized in the radial direction and as a result, the cylinder head 2 and a head cover 3 can be miniaturized.

Figure 13:
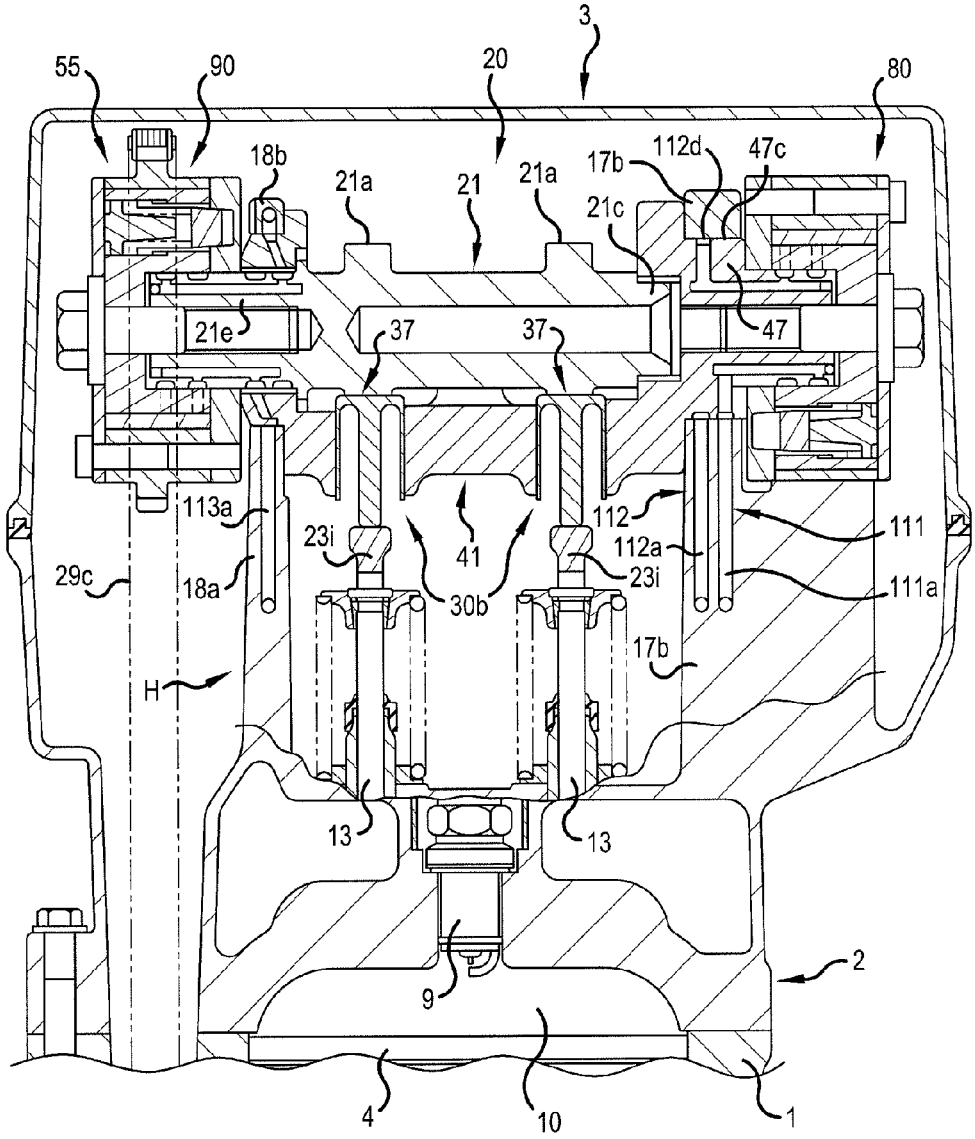
FIG. 13 shows a fifth embodiment of the invention and shows a main part on the similar section to that in FIG. 12.

Referring to FIG. 13, a fifth embodiment will be described below.

The fifth embodiment is different from the fourth embodiment mainly in that a variable valve system 20 is provided with no valve halt mechanism 60. The other features have basically the same configuration. Therefore, the description of the same parts is omitted or simplified and different points will be mainly described below. The same reference numerals are used for the same members or the corresponding members as the members in the fourth embodiment if necessary.

The variable valve system 20 is provided with an inlet camshaft 21, an inlet cam 21*a*, an intake rocker arm 23*i*, a lift quantity variable mechanism 30*b*, a hydraulic actuator 80 that drives a lifter holder 41 of the lift quantity variable mechanism 30*b* and a timing variable mechanism 55.

The lift quantity variable mechanism 30*b* that operates a normally operated intake valve 13 is provided with two lifters 37 supported by the lifter holder 41.

An oil passages is configured as an oil passage 112 for a high lift. An oil passage 112*a* is provided to a lower bearing part 17*a* and an oil passage 112*d* is an annular groove provided to a periphery 47*c*.

According to the fifth embodiment, the similar action and effect to those in the first embodiment are produced in that the lift quantity variable mechanism 30*b* is provided to the normally operated intake valve 13, and a similar action and effect to those in the fourth embodiment are produced in that the inlet camshaft 21 is rotatably supported by the cam holder H via the lifter holder 41 and in that an actuator that drives the lift quantity variable mechanism 30*b* is the hydraulic actuator 80.

Figure 14:
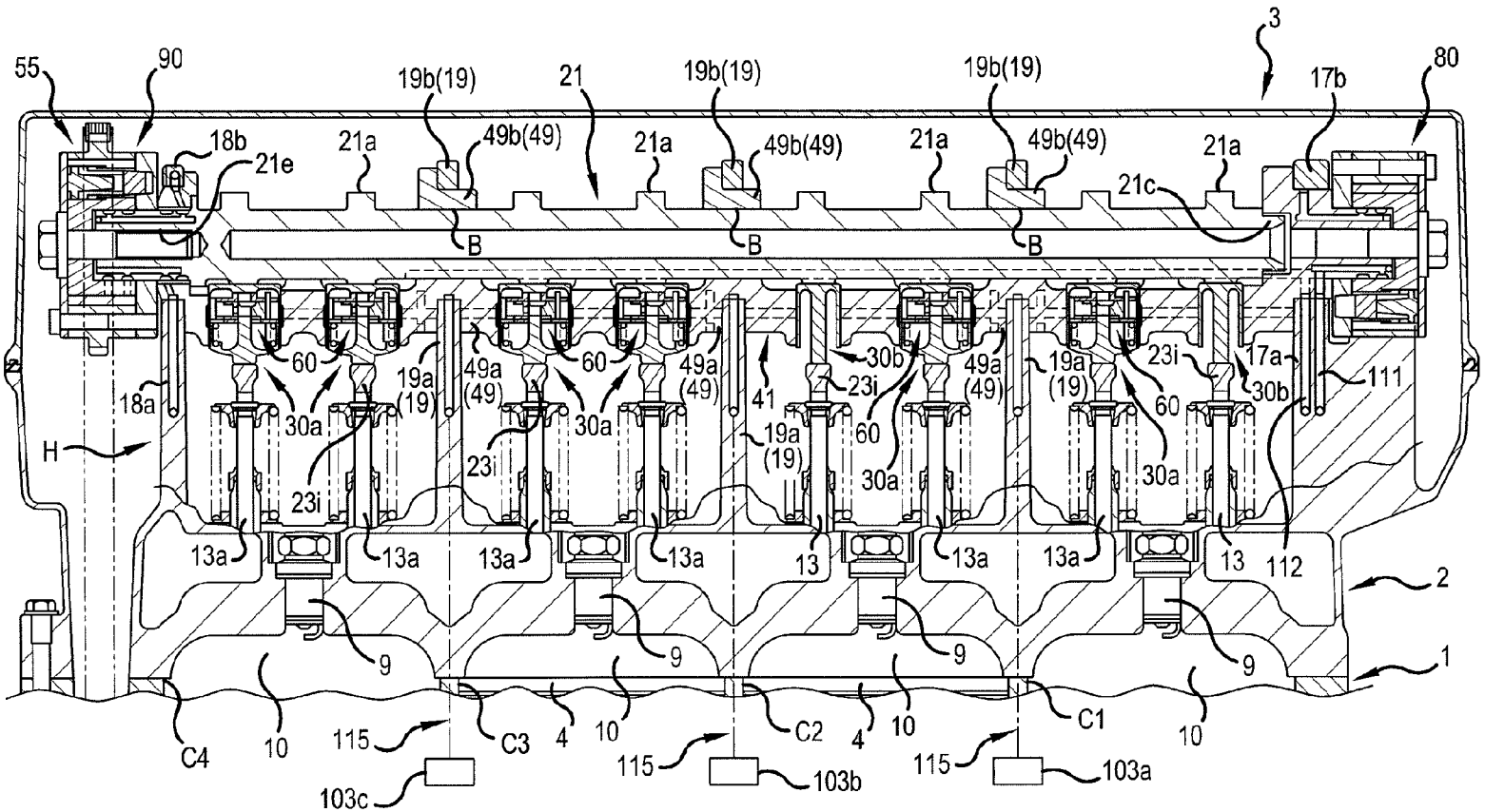
FIG. 14 shows a sixth embodiment of the invention and shows a main part on the similar section to that in FIG. 12.

Referring to FIG. 14, a sixth embodiment will be described below.

The sixth embodiment is different from the fourth embodiment mainly in that an internal combustion engine E is a multi-cylinder engine. In addition, the sixth embodiment is different from the second embodiment mainly in that an actuator that drives lift quantity variable mechanisms 30*a*, 30*b* is a hydraulic actuator 80. The other basic configuration is the same. Therefore, the description of the same parts is omitted or simplified and different points will be mainly described below. The same reference numerals are used for the same members or the corresponding members as the members in the fourth embodiment if necessary.

A variable valve system 20 of the internal combustion engine E, provided with four cylinders C1 to C4 arranged in line, is provided with an inlet camshaft 21, an inlet cam 21*a*, an intake rocker arm 23*i*, the lift quantity variable mechanisms 30*a*, 30*b*, the hydraulic actuator 80 that drives the lifter holder 41 of the lift quantity variable mechanisms 30*a*, 30*b* and a timing variable mechanism 55.

A cam holder H that rotatably supports the inlet camshaft 21 via the lifter holder 41 is provided with first and second bearings 17, 18 that rotatably support one end 21*c* and the other end 21*e* and three intermediate bearings located between both bearings 17, 18 in their axial direction. Each intermediate bearing 19 is configured by a lower bearing part 19*a* integrated with a cylinder head 2 and an upper bearing part 19*b* connected to the lower bearing part 19*a* by a bolt.

The lifter holder 41 is configured by first and second supported parts and intermediate supported parts 49 that rotatably support the inlet camshaft 21 between both ends 21*c*, 21*e* via a bearing B and are supported by each intermediate bearing 19. Each intermediate supported part 49 having a similar half divided structure to that of the second supported part 48 is configured by a first half 49*a* and a second half 49*b*.

An oil passage on the side of a low lift 112 is similar to that in the fifth embodiment.

An oil passage for a halt 115 is provided across each intermediate bearing 19 and across the lifter holder 41. The supply and the exhaust of hydraulic fluid to/from a valve halt mechanism 60 of the cylinders C1, C2 are controlled by a pressure control valve 103*a*, the supply and the exhaust of hydraulic fluid to/from a valve halt mechanism 60 of the cylinder C3 are controlled by a pressure control valve 103*b*, and the supply and the exhaust of hydraulic fluid to/from a valve halt mechanism 60 of the cylinder C4 are controlled by a pressure control valve 103*c*.

According to the sixth embodiment, except that lifters held by the lifter holder 41 are the integrated lifter 37, a similar action and effect to those in the second embodiment are produced, and the inlet camshaft 21 is rotatably supported by the cam holder H via the lifter holder 41 and the actuator that drives the lift quantity variable mechanisms 30*a*, 30*b* is the hydraulic actuator 80. Thus, a similar action and effect to the action and effect in the fourth embodiment are produced.

Figure 15:
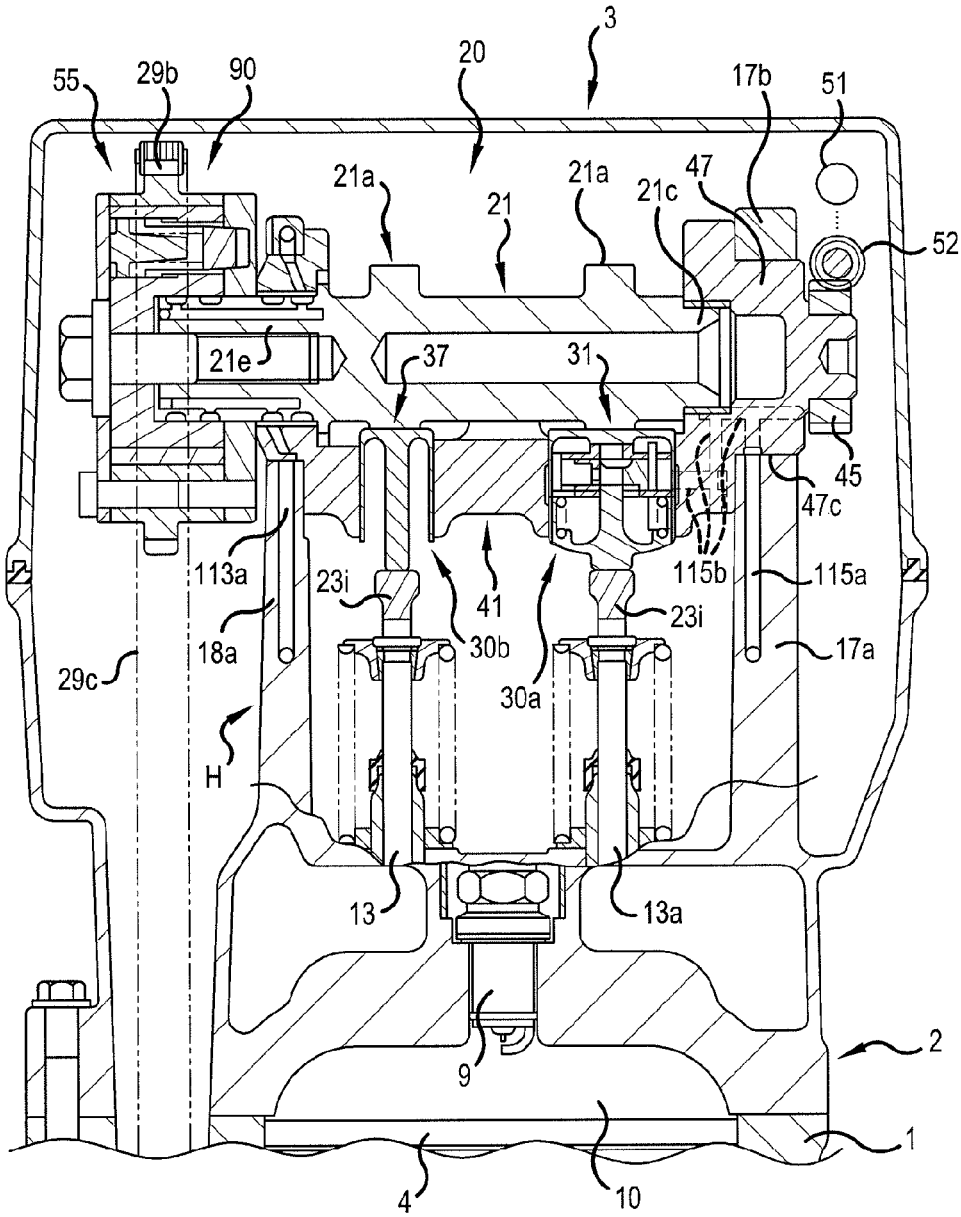
FIG. 15 shows a seventh embodiment of the invention and shows a main part on the similar section to that in FIG. 12.

Referring to FIG. 15, a seventh embodiment will be described below.

The seventh embodiment is different from the fourth embodiment mainly in that an actuator that drives a lift quantity variable mechanism is an electric motor. The other features are basically the same configuration as the fourth embodiment. Therefore, the description of the same parts is omitted or simplified and different points will be mainly described below. The same reference numerals are used for the same members or the corresponding members as the members in the fourth embodiment if necessary.

A variable valve system 20 is provided with an inlet camshaft 21, an inlet cam 21*a*, an intake rocker arm 23*i*, lift quantity variable mechanisms 30*a*, 30*b*, the electric motor 51 that drives a lifter holder 41 of the lift quantity variable mechanisms 30*a*, 30*b* and a timing variable mechanism 55.

The driving force of the electric motor 51 attached to a head cover 3 is transmitted to a gear part 45 engaged with a driving gear 52 via the driving gear 52 provided to a rotating shaft of the electric motor 51, the lifter holder 41 is driven by the electric motor 51, and is rocked. The gear part 45 integrated with a first supported part 47 is a part in the lifter holder 41 on which the driving force of the electric motor 51 acts. The driving gear 52 and the gear part 45 respectively configure a worm and a worm gear as a worm wheel.

According to the seventh embodiment, a similar action and effect to those in the fourth embodiment are produced except that the actuator that drives the lift quantity variable mechanisms 30*a*, 30*b* is the electric motor 51.

A changed configuration of an embodiment in which the configuration of a part in the above-mentioned embodiments is changed will be described below.

The lift quantity variable mechanism 30 is provided to all the intake valves and all the exhaust valves, however, independent of the number of cylinders with which an internal combustion engine is provided, a lift quantity variable mechanism has only to be provided to at least one of a plurality of engine valves including intake valves and exhaust valves in one cylinder.

A valve halt condition in which the intake valve or the exhaust valve is substantially kept closed may be also realized by changing the configuration of an abutting surface 26*a* of an abutting part 26.

The internal combustion engine may be one in which the quantity of intake air is controlled by only the intake valve and no throttle valve is provided to an intake passage.

The valve halt mechanism may be one which is configured by a driving rocker arm provided with a valve pressing part that presses the intake valve or the exhaust valve, a free rocker arm on which the lifter of the lift quantity variable mechanism abuts and a coupling element such as a coupling pin the movement of which is controlled by oil pressure and in which the driving rocker arm and the free rocker arm are switched into a coupled condition wherein the intake valve or the exhaust valve is operated and into a coupling release condition wherein the valve is halted by the coupling element.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A variable valve system of an internal combustion engine having a cam operatively connected to a cam shaft, a rocker arm rocked by the action of a valve driving force of the cam, a lift quantity variable mechanism that varies maximum lift quantity of an engine valve and an actuator that drives the lift quantity variable mechanism wherein the cam opens and closes the engine valve via the rocker arm, comprising:

a lifter operatively connected to the lift quantity variable mechanism, said lifter being driven by the cam for applying the valve driving force to the rocker arm; and a lifter holder for supporting the lifter, said lifter holder being driven by the actuator and rocked;

wherein the maximum lift quantity is varied by varying a position in which the lifter abuts on a concave abutting part of the rocker arm according to a position of the lifter holder, wherein the camshaft is rotatably supported by a cam holder via the lifter holder rockably supported by the camshaft.

2. The variable valve system of the internal combustion engine according to claim 1, wherein the lifter is provided with an input lifter that abuts on the cam, an output lifter that abuts on the rocker arm and a pressing member that presses the input lifter and the output lifter on the cam and on the rocker arm; and the input lifter and the output lifter can be relatively moved in a direction pressed by the pressing member.

3. The variable valve system of the internal combustion engine according to claim 1, and further including a valve halt mechanism for halting the engine valve without varying a position of the lifter holder;

wherein the lift quantity variable mechanism can continuously vary the maximum lift quantity.

4. The variable valve system of the internal combustion engine according to claim 3, wherein the lifter is provided with an input lifter for abutting on the cam and an output lifter for abutting on the rocker arm; and the valve halt mechanism transmits and disconnects the valve driving force between the input lifter and the output lifter.

5. The variable valve system of the internal combustion engine according to claim 1, wherein the engine valve is operatively connected to a cylinder head of the internal combustion engine and is at least one of a plurality of engine valves per one cylinder; and the actuator is arranged between the plurality of engine valves when the actuator is viewed in an axial direction of the cylinder.

6. The variable valve system of the internal combustion engine according to claim 2, wherein the engine valve is operatively connected to a cylinder head of the internal combustion engine and is at least one of a plurality of engine valves per one cylinder; and the actuator is arranged between the plurality of engine valves when the actuator is viewed in an axial direction of the cylinder.

7. The variable valve system of the internal combustion engine according to claim 3, wherein the engine valve is operatively connected to a cylinder head of the internal combustion engine and is at least one of a plurality of engine valves per one cylinder; and the actuator is arranged between the plurality of engine valves when the actuator is viewed in an axial direction of the cylinder.

8. The variable valve system of the internal combustion engine according to claim 4, wherein the engine valve is operatively connected to a cylinder head of the internal combustion engine and is at least one of a plurality of engine valves per one cylinder; and the actuator is arranged between the plurality of engine valves when the actuator is viewed in an axial direction of the cylinder.

9. The variable valve system of the internal combustion engine according to claim 1, wherein the rocker arm includes a fulcrum part at one end, a valve pressing part at an opposite end, and the concave abutting part is located between the fulcrum part and the valve pressing part.

10. The variable valve system of the internal combustion engine according to claim 1, wherein the camshaft is rotatably supported by a cam holder;

one end and the other end of the camshaft are rotatably supported by a first bearing and a second bearing of the cam holder;

the actuator is a hydraulic actuator attached to the first bearing; and an oil passage for hydraulic fluid for operating the actuator is provided to the first bearing.

11. The variable valve system of the internal combustion engine according to claim 10, wherein the one end is rotatably supported by the first bearing via the lifter holder rockably supported by the first bearing; and an oil passage which makes the oil passage and the actuator communicate and in which the hydraulic fluid is led is provided to the lifter holder.

12. A variable valve system adapted for use with an internal combustion engine comprising:

a cam operatively connected to a cam shaft;

a rocker arm rocked by the action of a valve driving force of the cam;

a lift quantity variable mechanism for varying a maximum lift quantity of an engine valve;

an actuator for driving the lift quantity variable mechanism wherein the cam opens and closes the engine valve via the rocker arm;

a lifter operatively connected to the lift quantity variable mechanism, said lifter being driven by the cam for applying the valve driving force to the rocker arm; and a lifter holder for supporting the lifter, said lifter holder being driven by the actuator and rocked;

wherein the maximum lift quantity is varied by varying a position in which the lifter abuts on the rocker arm according to a position of the lifter holder, wherein the camshaft is rotatably supported by a cam holder via the lifter holder rockably supported by the camshaft.

13. The variable valve system adapted for use with the internal combustion engine according to claim 12, wherein the lifter is provided with an input lifter that abuts on the cam, an output lifter that abuts on the rocker arm and a pressing member that presses the input lifter and the output lifter on the cam and on the rocker arm; and the input lifter and the output lifter can be relatively moved in a direction pressed by the pressing member.

14. The variable valve system adapted for use with the internal combustion engine according to claim 12, and further including a valve halt mechanism for halting the engine valve without varying a position of the lifter holder;

wherein the lift quantity variable mechanism can continuously vary the maximum lift quantity.

15. The variable valve system adapted for use with the internal combustion engine according to claim 14, wherein the lifter is provided with an input lifter for abutting on the cam and an output lifter for abutting on the rocker arm; and the valve halt mechanism transmits and disconnects the valve driving force between the input lifter and the output lifter.

16. The variable valve system adapted for use with the internal combustion engine according to claim 12, wherein the engine valve is operatively connected to a cylinder head of the internal combustion engine and is at least one of a plurality of engine valves per one cylinder; and the actuator is arranged between the plurality of engine valves when the actuator is viewed in an axial direction of the cylinder.

17. The variable valve system adapted for use with the internal combustion engine according to claim 13, wherein the engine valve is operatively connected to a cylinder head of the internal combustion engine and is at least one of a plurality of engine valves per one cylinder; and the actuator is arranged between the plurality of engine valves when the actuator is viewed in an axial direction of the cylinder.

18. A variable valve system adapted for use with the internal combustion engine, comprising:

a cam operatively connected to a cam shaft;

a rocker arm rocked by the action of a valve driving force of the cam;

a lift quantity variable mechanism for varying a maximum lift quantity of an engine valve;

an actuator for driving the lift quantity variable mechanism wherein the cam opens and closes the engine valve via the rocker arm;

a lifter operatively connected to the lift quantity variable mechanism, said lifter being driven by the cam for applying the valve driving force to the rocker arm; and a lifter holder for supporting the lifter, said lifter holder being driven by the actuator and rocked;

wherein the maximum lift quantity is varied by varying a position in which the lifter abuts on the rocker arm according to a position of the lifter holder, wherein the camshaft is rotatably supported by a cam holder;

one end and the other end of the camshaft are rotatably supported by a first bearing and a second bearing of the cam holder;

the actuator is a hydraulic actuator attached to the first bearing; and an oil passage for hydraulic fluid for operating the actuator is provided to the first bearing.

19. The variable valve system adapted for use with the internal combustion engine according to claim 18, wherein the one end is rotatably supported by the first bearing via the lifter holder rockably supported by the first bearing; and an oil passage which makes the oil passage and the actuator communicate and in which the hydraulic fluid is led is provided to the lifter holder.

* * * * *